US010233660B2

(12) United States Patent
Lochtefeld et al.

(10) Patent No.: US 10,233,660 B2
(45) **Date of Patent: *Mar. 19, 2019**

(54) APPARATUS FOR PRODUCING WAVES FOR SURFING USING STAGGERED WAVE GENERATORS EXTENDED ALONG A CURVED STAGGER LINE

(71) Applicants: Thomas J. Lochtefeld, La Jolla, CA (US); Dirk Bastenhof, Ede (NL)

(72) Inventors: Thomas J. Lochtefeld, La Jolla, CA (US); Dirk Bastenhof, Ede (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/419,708

(22) Filed: Jan. 30, 2017

(65) Prior Publication Data

US 2017/0138074 A1 May 18, 2017

Related U.S. Application Data

(63) Continuation of application No. 14/073,945, filed on Nov. 7, 2013, now Pat. No. 9,556,633, which is a continuation-in-part of application No. 14/115,415, filed as application No. PCT/SG2011/000176 on May 4, 2011, now Pat. No. 9,777,494.

(60) Provisional application No. 61/723,598, filed on Nov. 7, 2012.

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01); *A63B 2208/03* (2013.01)

(58) Field of Classification Search
CPC ... E04H 4/0006; F04D 35/00; A63B 69/0093; A63B 69/125
USPC ..... 4/491; 405/79–80
See application file for complete search history.

(56) References Cited

U.S. PATENT DOCUMENTS

| | | | |
|---|---|---|---|
| 3,350,724 | A | 11/1967 | Leigh |
| 3,629,877 | A | 12/1971 | Shuster |
| 3,913,332 | A | 10/1975 | Forsman |
| 4,062,192 | A | 12/1977 | Biewer |
| 4,515,500 | A | 5/1985 | Bastenhof |
| 4,999,860 | A | 3/1991 | Chutter et al. |
| 5,342,145 | A | 8/1994 | Cohen |
| 5,833,393 | A | 11/1998 | Carnahan et al. |
| 6,920,651 | B2 | 7/2005 | Roberts |
| 6,964,069 | B2 | 11/2005 | English et al. |
| 7,144,197 | B2 | 12/2006 | Black |
| 2011/0209280 | A1 | 9/2011 | Enjo |

*Primary Examiner* — Erin Deery
(74) *Attorney, Agent, or Firm* — J. John Shimazaki

(57) ABSTRACT

A wave pool having a deep end and a shallow end with a plurality of wave generators along the deep end that are extended along a curved stagger line positioned at an oblique angle relative to the moving waves. The wave generators are preferably extended in a substantially staggered manner relative to the travel direction of the waves. A pair of dividing walls is preferably provided in front of each generator, wherein the dividing walls are extended substantially forward with a fade angle of no more than about 20 degrees relative to each other. The wave generators are preferably operated in sequence, such that a plurality of wave segments is generated, and such that the wave segments travel forward and then merge together to form a substantially uniform resultant wave which travels forward and then breaks along the shallow end.

20 Claims, 7 Drawing Sheets

APPARATUS FOR PRODUCING WAVES FOR SURFING USING STAGGERED WAVE GENERATORS EXTENDED ALONG A CURVED STAGGER LINE

RELATED APPLICATIONS

This application is a continuation of U.S. application Ser. No. 14/073,945, filed on Nov. 7, 2013, which issued as U.S. Pat. No. 9,556,633 on Jan. 31, 2017, which claims the benefit of the filing date of U.S. Provisional Application Ser. No. 61/723,598, filed on Nov. 7, 2012, and which is a continuation in part of U.S. application Ser. No. 14/115,415, filed on Nov. 4, 2013, which issued as U.S. Pat. No. 9,777,494 on Oct. 3, 2017, and is related to and claims the benefit of the filing date of International Application No. PCT/SG2011/000176, filed May 4, 2011.

FIELD OF THE INVENTION

The present invention relates to the field of wave pools, and in particular, to a wave pool that comprises using multiple staggered wave generators extended along a curved stagger line in sequence with dividing walls extending forward in front of each wave generator that enable individual wave segments to be formed and merged together to form a resultant wave that breaks along a shoreline.

BACKGROUND OF THE INVENTION

Becoming a good surfer requires a combination of natural ability, skill and practice and learning to make continual adjustments while standing on a longitudinally oriented surfboard as it skims forward across a wave, such that while the surfer leans and makes adjustments to carve out the proper path, he or she can remain balanced and be propelled forward at just the right velocity and angle. In this respect, surfing requires the surfer to keep the board in a constantly changing equilibrium state, while maintaining constant awareness of his or her position relative to the board, and the board's position relative to the wave, wherein the board and surfer are synchronized together while moving forward in various angles and directions, and performing maneuvers using gravity and the sloped surface of the moving wave.

Because of the need to synchronize these movements carefully, it is important that the wave the board travels on is of sufficient size, shape and quality to enable the surfer to generate enough speed and use the ramps, transitions, sections and hollow tubes that are created on the wave to perform various tricks and maneuvers thereon. Moreover, the wave surface that the board travels on, and cuts across, must be sufficiently smooth and free of turbulence and discontinuities, to allow the surfer to perform the desired maneuvers, wherein, if there are any irregularities in the wave's structure, such as ridges, angles, ripples, vortices, chops, etc., the wave will be difficult to maneuver across and stay balanced on. And based on the size of a standard surfboard, including its overall width, length and thickness, it is critical that the smooth portion of the wave be sufficiently large/wide enough such that the board can be fully supported by the wave structure, wherein, as the board skims and maneuvers across the wave, the surfer is then able to make the necessary adjustments to stay balanced and move forward while performing maneuvers of interest. If there is too much turbulence, for example, or if the smooth portion of the wave is not large/wide enough, the board can be diverted, or misdirected, which can force the surfer to have to make quick compensating adjustments, which can increase the chance that a wipe out can occur.

Due to the size of a standard surfboard, which is typically about 18 to 20 inches (40 cm to 50 cm) wide, and about 2 to 3 inches (5 cm-7 cm) thick, and about 70 to 120 inches (2 to 3 meters) long, as well as its shape, which can have a taper or curve to facilitate carving, it is desirable that the smooth portion of the wave be wide enough to support this width as well as the board's varied movements. For example, if there are large ripples, bumps or chops that are spaced apart every 12 to 24 inches (30 to 60 cm) or so, then, as the board encounters these formations, the surfer will have to use a more conservative (minimal maneuver) stance, with knees bent (to act as shock absorbers), and make quick adjustments, to keep the board on its proper path and avoid a wipeout, as the surfer travels forward. Indeed, one of the significant drawbacks to surfing on a low quality wave is that the board itself can be undesirably diverted, such as, for example, when the tip of the board enters into a chop, in which case, the nose of the board can dive into the water, which, in surf speak, is known as 'pearling', and will most often result in a wipe out.

In the past, because there are only a few places in the world where quality surfable waves are created naturally, it has been necessary for surfers to travel great distances to surf. And oftentimes, moments when ideal weather conditions exist can be relatively rare, thereby making it difficult for surfers to pursue their sport and catch a great wave. And given the lack of available resources most surfers have, greater emphasis has been placed on creating man-made waves using wave pools.

Wave pools are man-made bodies of water in which waves are created to simulate waves in an ocean. A wave pool typically has a wave generating device at one end and an artificial sloped "beach" located at the other end, wherein the wave generating device creates disturbances in the water that produce waves such as periodic waves that travel from one end to the other. The floor of the shoreline is preferably sloped upward so that as the waves approach, the floor causes the waves to change shape and "break" onto the beach.

One of the shortcomings of traditional wave pools is that they are typically large and therefore require significant land and therefore are relatively expensive to build. Also, to produce large surfable waves, not only does the pool have to be large, but the wave generators themselves have to be bigger and more powerful to push more water to create the desired surfable waves. Some wave pools have been built with multiple wave generators positioned side by side along the deep end, which are capable of being activated at the same time to produce a single wave that travels from the deep end to the shallow end. Typically, in such case, each wave generator is activated at the same time to simultaneously create a single resultant wave that progresses across the pool and breaks.

In Cohen, U.S. Pat. No. 5,342,145, a wave generating facility having an angled reef for producing plunging type waves is shown, wherein multiple wave generators are provided at an oblique angle along the offshore side of the reef to generate multiple waves in sequence, wherein the waves are said merge together to form a single wave that peels laterally along the reef. In Cohen, the wave generators are staggered and positioned at an oblique angle relative to the front or crest of the moving waves, and likewise, the reef is extended along the same oblique angle, such that, as the waves progress, they will peel and break laterally across the reef.

One deficiency of Cohen, however, is that the wave generators are situated in open water with no provisions being made for how the wave segments will form and merge together to form a single resultant wave. Because the wave generators face the open water, and the multiple wave segments that they produce have to merge together in the open pool, natural forces and disturbances can occur along the convergence zones, including undesirable eddies and flow sheers, which can prohibit the formation of a smooth surfable wave. What Cohen fails to take into account is that when these wave segments converge and disturbances occur, these motions will negatively impact the near-term formation of an ensuing wave, wherein any wave that follows (such as within an approximate 45 second time frame) will encounter considerable instabilities, e.g., ripples, chops and vortices, etc., that are unstable and therefore unsuitable for surfing. Furthermore, the energy consumed by generating such disturbances can reduce the overall size, height and amplitude of the desired waves.

In Leigh, U.S. Pat. No. 3,350,724, a method and apparatus for generating artificial waves in a body of water is shown, wherein multiple wave generators for producing individual waves that merge together are shown. According to Leigh, each wave generator is provided with a pair of angled walls extending forward, to cause the waves to elongate as they travel forward, so that once the waves merge together, they create a single resultant wave with an elongated front that is longer than the width of the wave generators combined. By substantially angling the walls in front of each wave generator, the waves will necessarily spread and elongate as they travel forward, which, according to Leigh, allows for the waves that are created to be substantially elongated, thus making it possible to create longer waves using fewer and shorter wave generators, which according to Leigh, "drastically" reduces the "cost, complexity, and power requirements" of the facility. According to Leigh, the objective achieved is that by angling the walls outward to what appears to be 60 to 70 degrees, fewer wave generators are needed to create the same length of wave along the beach.

One serious disadvantage of Leigh, however, is that because the walls are angled to such a degree, the waves will spread out and elongate unduly, creating a significant lateral or down-the-line velocity component (i.e., in a direction down-the-line along the wave crest) as each wave travels forward, wherein the waves will eventually arc radially outward and collide against each other with force, rather than merge together smoothly to form a uniform resultant wave. That is, as the waves travel forward, not only will they travel in a substantial arc motion, i.e., radially outward, but they will also widen and elongate as they follow along the angle of the walls, wherein a lateral down-line velocity vector will be created such that when adjacent waves converge together, they will inevitably collide against each other with significant force and effect, which can create additional turbulence that can prevent the formation of smooth surfable waves.

Likewise, the elongation of the waves created by Leigh will, by virtue of the principles of energy conservation, cause the waves to drop significantly in height/amplitude as they travel forward. That is, by virtue of the waves elongating, the energy of the wave will have to be spread out along a greater distance, which necessarily decreases the height of the waves. Also, the extra turbulence and disturbance caused by the waves interfering with and colliding against each other will cause the waves to redirect energy, thereby further contributing to a reduction in wave height and amplitude. Accordingly, not only will the height/amplitude of the waves be reduced over time, but additional energy will be required to create the same size resultant wave.

For the above reasons, a need exists to design and build a wave pool using a plurality of wave generators positioned side by side along the deep end thereof to produce wave segments that merge together properly as they travel forward to create a single wave that is sufficiently smooth for surfing, and that overcomes the deficiencies of previous wave pool designs, before they peel and break along the shore.

SUMMARY OF THE INVENTION

The present invention represents an improvement over previous wave pool designs comprising multiple wave generators positioned side by side in that the resultant wave formed by merging the wave segments together is a high quality surfable wave with little or no surface instabilities due to improved wave generation and positioning, etc. The wave pool of the present invention preferably has a relatively deep end and a relatively shallow end, wherein the wave generators are located along the deep end and the shoreline is located along the shallow end, wherein an inclined shoaling floor is extended in-between, and in the present invention, the wave generators are preferably oriented along a curved stagger line that is at an oblique angle relative to the lateral down-the-line direction of the wave front, wherein the wave generators are also staggered, and have a pair of dividing walls extended in front of each one, such that, as the wave generators are operated sequentially, one after the other, the wave segments will merge together to form a smoothly shaped resultant wave suitable for surfing. By providing dividing walls in front of each wave generator with a limited outward fade angle between them, the wave segments will be allowed to form properly without losing significant height/amplitude and without unduly elongating, as in Leigh. This also helps reduce the wave height differential between adjacent wave segments, wherein the end result is that they can merge to produce a resultant wave with reduced turbulence and wave energy loss and minimal reduction in wave height/amplitude, etc.

Although different pool configurations are possible, the preferred embodiment has wave generators that are extended along a curved stagger line, with the sloped shoaling floor extended between the deep end and the shallow end, and wherein the breaker line is also extended along a similar curved path, such as substantially parallel to the curved stagger line, wherein the shoaling floor extends between them and helps to cause the waves to break obliquely toward shore, wherein the waves that are formed will break obliquely forward and then peel laterally across the width of the pool.

Preferably, the wave generators are positioned along the curved stagger line, such that each succeeding wave generator in the series is located further downstream than the preceding wave generator, and at a slightly greater angle relative to the immediately preceding wave generator. For example, the second wave generator is preferably located further downstream and at a slightly greater angle than the first wave generator, and the third wave generator is preferably located further downstream and at a slightly greater angle than the second wave generator, wherein the last wave generator in the series will be located further downstream than any previous wave generator in the series and at a greater angle relative to the preceding wave generators.

In this respect, the angle between each wave generator in the series is preferably the same as the outward fade angle of the dividing walls for each wave generator, wherein the orientation and position of the wave generators in this manner helps form the curved stagger line, and contributes to the overall formation and configuration of the waves. The wave generators are preferably positioned along a curved stagger line, rather than a straight stagger angle, as in Applicant's previous application, PCT/SG2011/000176, which is incorporated herein by reference.

With multiple wave generators positioned side by side in this manner, it can be seen that each wave generator can be activated sequentially, one after the other, with a predetermined time interval between them, wherein each wave segment will need time to progress forward and develop properly before merging with adjacent wave segments that will be travelling forward. And because the wave generators are preferably substantially staggered, and positioned along a curved stagger line, it can be seen that in order for the wave segments to merge properly, the activation of each wave generator will have to be timed and take into account the time it takes for each wave segment to travel forward through the dividing walls before merging with an adjacent wave segment at the end thereof, formed by adjacent wave generators in the series.

One preferred aspect of the present invention is the existence of a pair of dividing walls extending forward in front of each wave generator that helps to confine the energy of the wave segments as they travel forward before merging. Each pair of dividing walls is preferably extended forward in the travel direction of the wave segments, such that they help confine the wave segments and the energy thereof, wherein the length, size (height/amplitude) and shape of the wave segments can be substantially maintained as they move forward, while giving them sufficient time to develop before merging with other wave segments in the sequence. This way, when the wave segments do merge, they are preferably travelling in substantially the same direction, at substantially the same speed, and can be substantially identical in size and shape, which can help avoid undesirable disturbances, interferences, and turbulences, such as excess eddies, flow sheers, and cross directional or secondary waves, etc., wherein the size and shape of the resultant wave can thereby be substantially preserved. At the same time, in the preferred embodiment, because each wave generator and its dividing walls are angled slightly relative to each other, a slight fade angle is typically provided between each pair of dividing walls, wherein the angle extending between each pair of dividing walls matches the angle between adjacent wave generators in the series.

Based on the above, the dividing walls preferably create three distinct wave formation zones in front of each wave generator, which help facilitate the formation, merging and transition of the resultant waves. These zones will now be discussed in the order in which they occur as the wave segments travel forward:

First, a Wave Formation Zone is created in between the two dividing walls in front of each wave generator. This zone is characterized by the existence of two dividing walls on either side through which the wave segments travel, wherein the length and energy of the wave segments is substantially confined and preserved. This Zone is designed to help confine the energy of the wave segments as they travel forward so that they can develop into the proper shape before entering into the merging zones.

One important characteristic of the dividing walls is that they are preferably extended substantially close to parallel with each other, or have a limited fade angle between them, wherein in the preferred embodiments, as will be discussed, they will only have an outward fade angle of no more than about 20 degrees, depending upon the overall desired wave size and peel angle to be achieved. By keeping the dividing walls close to parallel, or otherwise limiting the outward fade angle, the wave segments will not elongate substantially or lose a significant amount of energy or size, etc., and by extending the dividing walls within this Zone in this manner, the following advantages can be achieved: 1) the wave segments will not substantially elongate or spread out, which reduces or eliminates the spread speed or down-the-line velocity vector and therefore can reduce excess turbulence as the wave segments merge, and 2) because the wave segments can maintain their length and height/amplitude, etc., and their wave energy is substantially preserved, they can fully develop and remain substantially unaltered in size and shape, as they travel forward through this Zone, which helps to reduce the undesirable disturbances that might occur when the wave segments merge. For purposes of this discussion, spread speed or down-the-line velocity describes a velocity vector in a direction longitudinally down the line of a given wave front, which is essentially perpendicular to the forward movement of the wave.

The second zone encountered by the wave segment as it moves forward is the Partial Wave Merging Zone which is extended just beyond the shorter dividing wall, and is characterized by the existence of one dividing wall on one side but open water on the other side, wherein the wave segments will begin to merge on one side (the side with the shorter dividing wall) with an adjacent wave segment in the series. This Zone preferably extends downstream from the distal end of the short dividing wall (on one side) to the distal end of the long dividing wall (on the opposite side). Even though this Zone only has one dividing wall, the wave segment that travels through this Zone is preferably confined on the opposite "open" side by the presence of an adjacent wave segment traveling in substantially the same direction, at substantially the same speed, and having substantially the same size and shape. That is, the "open" end of the wave segment will effectively merge with an adjacent wave segment formed by a preceding wave generator in the series travelling alongside it, i.e., travelling in substantially the same direction, wherein both wave segments will be substantially confined on both sides (one side by the long dividing wall and the other side by the adjacent wave segment travelling in the same direction), wherein this confinement will help to maintain the height/amplitude and shape and length of the resultant wave. Although there is only one dividing wall that confines the wave segments within this Zone, when timed properly, the two adjacent wave segments that merge together will be able to merge together properly, without producing undesirable disturbances and turbulence, such as excess eddies, flow sheers and cross directional or secondary waves, which can negatively impact the smooth formation and transition of the desired resultant wave.

Third, the next zone encountered by the wave segment is the Full Wave Merging Zone which is located downstream beyond the dividing walls and is characterized by open water on both sides, wherein the other end of the wave segment (which has not merged yet) will merge with an adjacent wave segment formed by a succeeding wave generator in the series travelling along the opposite end, wherein the two wave segments will be travelling in substantially the same direction, at substantially the same speed, and having substantially the same size and shape, as was the case on the other side, to form the smoothly shaped resultant wave. This Zone extends just beyond the distal end of the long dividing wall, and extends forward into the pool, such as into the shoaling zone, toward the shallow end. Because there is no dividing wall on either side, the wave segments that travel through this Zone will be confined on the opposite ends by other wave segments travelling in the same direction—formed by a preceding wave generator on one end and a succeeding wave generator on the opposite end—in the series. And because the preceding and succeeding wave segments also travel in substantially the same direction, at substantially the same speed, with substantially the same size and shape, the wave segments that merge together will help form a consistently shaped resultant uniform wave.

As these wave segments travel forward and merge together, one after another, first on one side, and then, on the opposite side, the size (height/amplitude) and shape of each wave segment preferably remains substantially constant, i.e., unaltered, which allows the merging wave segments to form a substantially smooth resultant wave, wherein undesirable eddies, flow sheers, and cross directional or secondary waves, that can negatively impact the formation of the waves, can be reduced. In the preferred embodiment, the dividing walls in front of each wave generator have an outward fade angle of no more than about 20 degrees, although preferably they have a fade angle of 15 degrees or less, and each wave generator in the series is preferably positioned along a curved stagger line, with the angle between each adjacent wave generator matching the outward fade angle. Stated differently, each succeeding wave generator in the series is preferably positioned at an angle incrementally greater than each preceding wave generator in the series, which is equivalent to the outward fade angle of each pair of dividing walls for each wave generator, which is preferably less than about 20 degrees. This way, the curvature of the curved stagger line becomes a function of the collective angles formed by all of the wave generators positioned next to each other in the series.

For example, if the outward fade angle of the dividing walls for a wave generator in one embodiment is 5 degrees (between each pair of dividing walls), then, each wave generator in the series is preferably positioned at a 5 degree angle relative to each other, i.e., the first wave generator is positioned at a 5 degree angle relative to the second wave generator, and the second wave generator is positioned at a 5 degree angle relative to the third wave generator, wherein the third wave generator will then be positioned at a 10 degree angle relative to the first wave generator, etc. And with each wave generator in the series extended at the same angle relative to each preceding wave generator in the series, it can be seen that the last wave generator in the series will then be positioned at an angle that is equivalent to the collective angles of all the wave generators combined. Thus, if there are eighteen wave generators, and the dividing walls in front of each wave generator has a fade angle of 5 degrees, the last wave generator in the series will be at a 90 degree angle relative to the first wave generator in the series, with each wave generator being positioned at a 5 degree angle relative to each other. Of course, the wave pool can be larger or smaller, in which case, an embodiment can have fewer or more than eighteen wave generators, i.e., a wave pool that is extended around a full circle can have seventy-two wave generators, each at a 5 degree angle relative to each other, extending around the full 360 degrees.

In this respect, it should be noted that virtually any pool configuration is within the contemplation of the present invention. For example, in one embodiment, nine wave generators with dividing walls having a 10 degree fade angle between them can be provided, wherein they can be oriented and positioned at a 10 degree angle relative to each other, and along a curved stagger line that extends about one-fourth of a circle (or 90 degrees). It can also be seen that by using wave generators and dividing walls that have varied fade angles between them, including a series where there is a 5 degree angle adjacent to a 6 degree angle adjacent to a 10 degree angle, virtually any number of wave generators, outward fade angles and configurations can be provided. The key is to keep the fade angles relatively close to parallel to one another or otherwise limited so as to provide the benefits described herein.

Regardless of the number of wave generators used, and the curvature of the stagger line, etc., the opposing shallow end of the wave pool is preferably extended along a similar curve, such that as the wave segments travel forward and merge together, the resultant wave will travel forward and begin breaking along a substantially curved break line, wherein the waves will also break along a similarly curved shoreline, wherein the distance that the waves have to travel downstream from the wave generators to the beach, i.e., before they break onto the shore, is preferably substantially constant, although not necessarily so, such that the breaking of the waves will occur at about the same distance downstream and along substantially the same line.

To the extent the peel angle helps enable the waves to break properly, it should be noted that the curvature of the break line can be varied, i.e., it doesn't have to be substantially parallel to the curved stagger line, such that the waves will break in the desired manner along the shoreline. The radiuses of the various curvatures can also be varied wherein the radius of the curved stagger line can be a function of the stagger distance, the width of the wave generator, and the outward fade angle of the dividing walls, etc., wherein the curvature of the break line and shoreline don't necessarily have to equal the curvature of the curved stagger line.

While various factors are involved in deciding how many wave generators to use, and how large or how small the wave pool should be, and what portion of a circle the curve should consist of, etc., several factors are preferably considered in determining the preferred outward fade angle of the dividing walls, which should then be factored into determining the preferred angle between the adjacent wave generators in the pool. As was discussed in Applicants' previous application, the dividing walls will perform best when they are substantially parallel to each other, which helps to substantially confine the energy of the wave segments as they progress forward, but given the curvature of the stagger line, the two dividing walls in this case are necessarily off parallel to some degree, and have a predetermined amount of outward fade angle between them, depending on a number of factors, as will be discussed, which can help determine the angle that exists between adjacent wave generators in the series and therefore dictate the overall configuration and size of the wave pool, etc.

In this respect, the following factors are preferably considered in determining the preferred outward fade angle for any given embodiment:

First, any degree of outward fade angle will cause the wave segments to elongate to some degree as they progress forward, wherein, by elongating the wave segments, or allowing them to spread out, a lateral down-the-line velocity vector can be introduced into the wave segments. And, because of the principle of energy conservation, when a wave segment is allowed to elongate or spread out, the wave segment's size (height/amplitude) as it travels forward will necessarily decrease, and because the wave generators are staggered and operated sequentially, one after the other, by the time any two adjacent wave segments merge together, one wave segment will have traveled a greater distance than the adjacent wave segment, which means that along the convergence line, there can be a significant height differential between them, which can cause undesirable disturbances and turbulences to occur, such as excess eddies and flow sheers. Thus, at some point, an increased outward fade angle and/or greater stagger distance will create secondary wave phenomenon that will interfere with the primary wave pattern and the formation of the resultant wave.

Stated differently, the elongation of the wave segments can undesirably cause an energy flux to occur, wherein, due to the fade angle of the caisson walls, at the point where the wave segments merge, each wave segment in the series will end up being wider than the preceding wave segment in the series, etc., and because the energy per unit width along the length of the wave segment is related to the square of the wave height, this means that the wave segment that is created earliest, that travels the furthest, will be lower in height than the next succeeding wave segment in the series, etc. Thus, the merging wave segments will have a wave height differential that is dependent on the outward fade angle and stagger distance, and consequently, if the stagger distance is too great and/or the outward fade angle is too high, the wave height differential along the convergence line will increase, resulting in irregularities and secondary adverse wave effects. For these reasons, the present invention contemplates that the above factors be taken into account when designing a wave pool having a specified outward fade angle, and preferably, the outward fade angle between them should be limited to about 5 to 10 degrees and certainly no more than 20 degrees. Another reason to limit the fade angle has to do with the overall configuration of the wave pool and how tight the radius of the curved stagger line should be, which is affected by the stagger distance, and other curves based on the fade angle.

Another improved aspect of the present invention is that because the wave generators are positioned along a curved stagger line, rather than a straight angle, the adjacent wave generators will also be positioned and oriented at an angle relative to each other, such that each successive wave generator in the series will be at a progressively greater angle relative to the first wave generator. And, because the dividing walls between adjacent wave generators have substantially parallel surfaces on opposing sides, and the wave segment created by each wave generator will travel in a direction that is perpendicular to the front of each wave generator, this allows the ends of the wave segments that travel forward and merge together along the convergence line to travel substantially parallel to each other, i.e., in substantially the same direction, such that when they do merge, the confluence created by the wave segments merging together will be substantially reduced.

This also reduces the likelihood of there being a significant collision between adjacent wave segments that can negatively impact the formation of the resultant wave, insofar as, with an increased down-the-line velocity, if the ends of the adjacent wave segments are travelling in substantially the same direction, i.e., parallel to each other, along the convergence line, there will be less impact between them as they merge. This helps to avoid the situation that occurred in Leigh, which is that, when the fade angle was too high, an undesirable condition was created, insofar as when the wave segments converged, they tended to collide against each other, wherein cross directional or secondary waves could interfere with the formation of the resultant wave and flow sheers and eddies contributed to misshaping the desired surface continuity of the primary surfing wave, thereby creating undesirable disturbances and turbulences which can cause bumps, chops, perturbations, eddies and flow sheers to occur, which can negatively impact the formation and transition of the desired wave.

Another aspect of the invention relates to placing a wave dampening system such as disclosed in U.S. Pat. No. 6,460,201 or 8,561,221, which are incorporated herein by reference, which can be provided along the shallow end to reduce undesirable wave effects such as rip currents and reverse flows, etc., which can adversely affect the breaking of the waves along the shoreline. A standard shoreline that has a floor that progresses upward at an incline from the deep end to the shallow end, or other sloped beach can be provided as well.

BRIEF DESCRIPTION OF THE DRAWINGS

FIG. 2 is a section view of the embodiment of FIG. 1, taken along the direction that the wave travels, wherein a wave generator is shown housed within a caisson on the left hand side, and a wave dampening system is shown on the right hand side, wherein a sloped shoaling floor is extended in between;

DETAILED DESCRIPTION OF THE INVENTION

Figure 1:
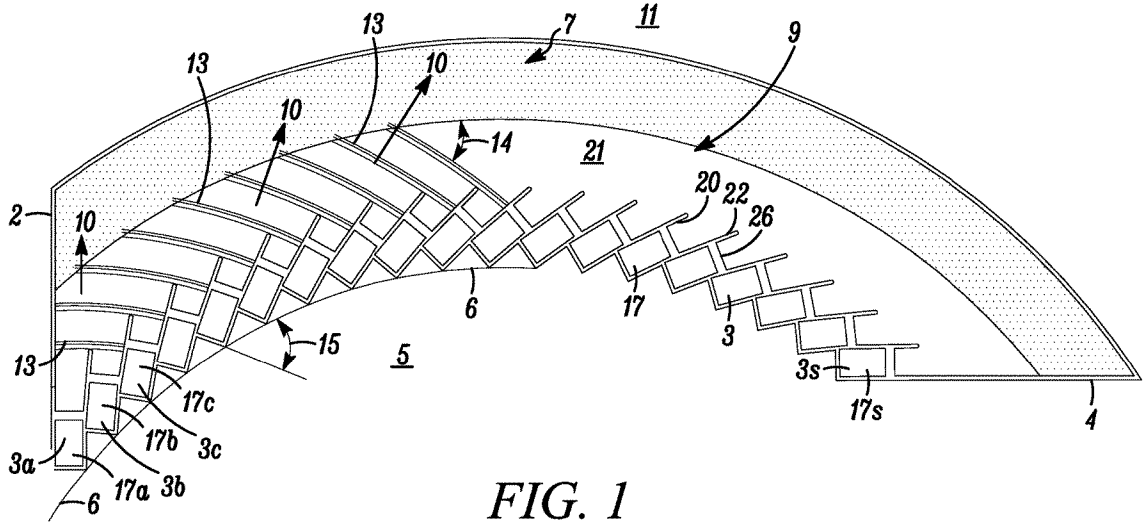
FIG. 1 is a plan view of an embodiment of the present invention wherein the wave generators are extended along the deep end, and the sloped shoaling area is extended along the shallow end, wherein the wave generators and shoaling area are extended along a substantially curved stagger line, wherein two dividing walls are extended in front of each wave generator to form individual wave segments that can merge to form a resultant wave travelling downstream toward the shallow end.

FIG. 1 is a plan view of an embodiment of wave pool 1 having a plurality of wave generators 3 extended along an obliquely oriented curved stagger line 6, along a relatively deep end 5, with a sloped shoaling floor 21, extended along a similarly curved and oriented breaker line 9, which extends along an opposing shoreline 7 on shallow end 11. In this embodiment, a series of wave generators 3 (extended along curved stagger line 6) and sloped shoaling floor 21 (extended along break line 9) are preferably extended substantially along the same arc or substantially parallel to each other, while at the same time, at a curved oblique angle relative to the lateral down-the-line front or crest of waves 13 (which travel in direction 10). Note: This view shows what may at first appear to be multiple resultant waves 13 formed one after another, but the waves 13 shown in FIG. 1 are intended to show the progress that one resultant wave 13 can make incrementally over time as it progresses across pool 1, i.e., it is not intended to show that that many waves, one after another, should be produced at once. Side walls 2, 4 are preferably extended on either side to form the shape of pool 1 from above.

Multiple wave generators 3 are preferably situated along curved stagger line 6 at an oblique angle relative to the front or crest of waves 13. Each wave generator 3 is preferably angled relative to each other, and in a staggered or offset manner, relative to the travel direction 10 of waves 13, as shown in FIG. 1. Also, each wave generator 3 is preferably housed within a substantially rectangular caisson 17, which is preferably staggered or offset relative to each other and positioned along curved stagger line 6, as shown. For example, first wave generator 3*a* is preferably housed in first caisson 17*a*, located adjacent side wall 2, and second wave generator 3*b* is preferably housed within second caisson 17*b*, which is preferably staggered forward and located downstream relative to first wave generator 3*a*. Likewise, third wave generator 3*c*, which is housed within third caisson 17*c*, is preferably staggered forward and located further downstream relative to second wave generator 3*b*, wherein the last wave generator in the series, i.e., 3*s*, located adjacent to side wall 4, is housed within caisson 17*s*, and is preferably staggered forward and located further downstream than any other wave generator in the series. The embodiment shown has nineteen (19) wave generators 3 extending across wave pool 1 which are housed in nineteen (19) caissons 17, each angled at about five (5) degrees relative to each other, which is substantially equivalent to the outward fade angle of each pair of dividing walls 20, 22 of each wave generator.

The angle 15 at which curved stagger line 6 extends relative to the front or crest of wave 13, as well as front wall 26 of each wave generator 3, is referred to as the "stagger angle," which represents the degree to which the wave generators 3 are offset or staggered relative to each other in travel direction 10. And, the distance that front wall 26 of each caisson 17 is located relative to the front wall 26 of each preceding/succeeding caisson 17 in the series, i.e., in direction 10, is referred to as the "stagger distance," which is shown as distance 69 in FIG. 4. Stagger distance 69 is essentially the distance that each wave segment must travel from front wall 26 of one wave generator (after it is created) before it reaches the next front wall 26 of the succeeding wave generator in the series.

Figure 4:
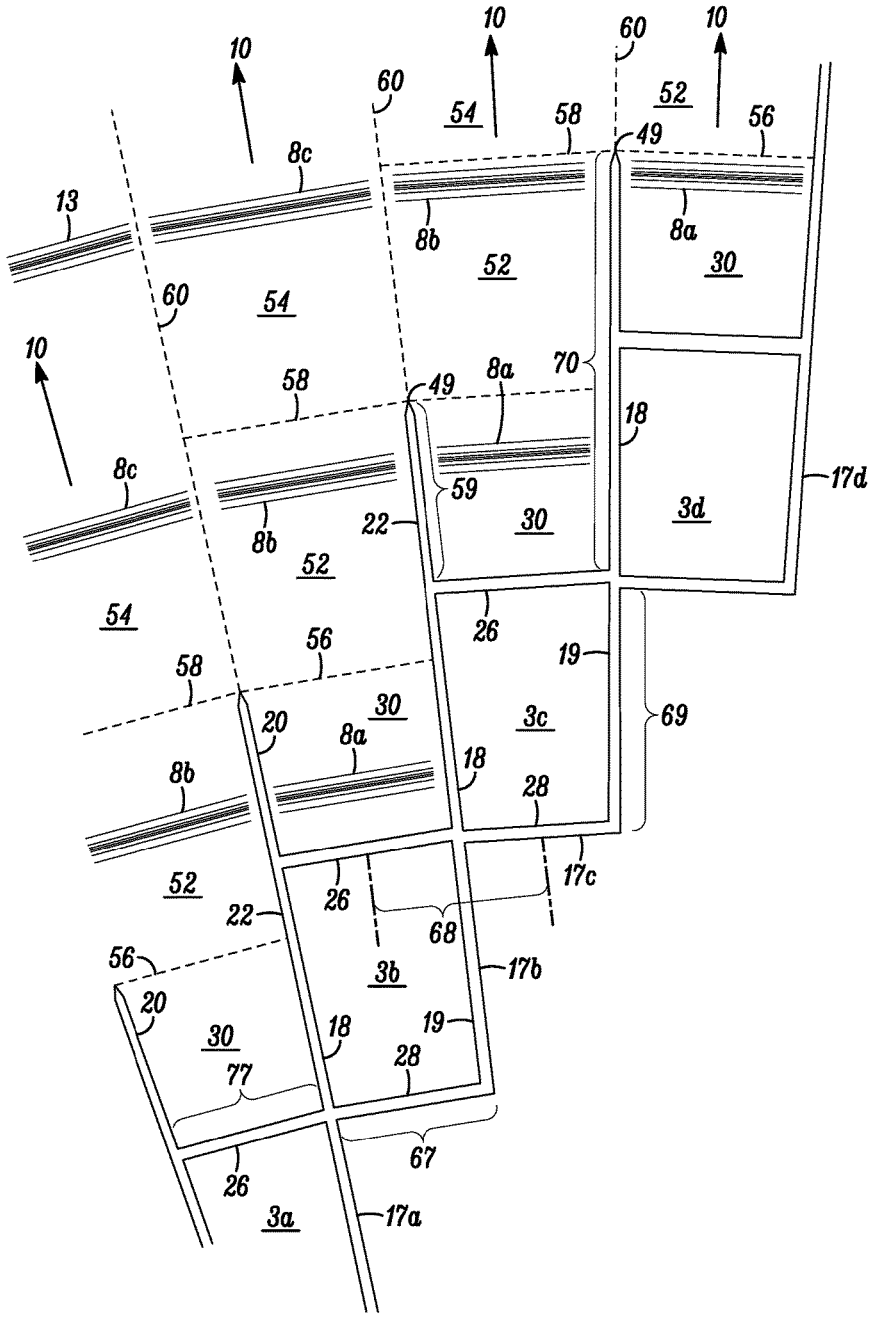
FIG. 4 is a detail of a portion of FIG. 1, wherein two dividing walls are extended in front of each wave generator, and three wave formation zones are created in front of each wave generator.

As shown in FIG. 4, each caisson, 17*a*, 17*b*, 17*c*, 17*d*, is preferably in substantially the shape of a rectangle from above, including front wall 26, a pair of side walls 18, 19 (extended at a slight angle relative to each other), and a back wall 28, and preferably, in front of each caisson 17 is a pair of dividing walls 20, 22, extended substantially longitudinally forward in direction 10 (also at a slight angle relative to each other). Preferably, dividing walls 20, 22 are extended substantially close to parallel to each other, or with an outward fade angle of up to 20 degrees, depending on a number of parameters, as will be discussed. Each wave generator 3 of the embodiment shown preferably has dividing walls 20, 22 with a fade angle of about five (5) degrees relative to each other. This way, the energy of the wave segments formed by each wave generator 3 can be substantially confined and retained within space 30 that extends in front of each wave generator 3, i.e., between dividing walls 20, 22, which represents the Wave Formation Zone. Space 30, in such case, is preferably confined on both sides, as well as along the bottom and back, such that the energy released by wave generator 3 will remain substantially confined and preserved as the wave segments 8*a*, 8*b*, 8*c*, created by wave generators 3 travel forward between the dividing walls 20, 22.

As shown in FIG. 1, peel angle 14 which extends between the front or crest of each wave 13 and break line 9 is the angle at which waves 13 will break and peel across break line 9. And, in the embodiment of FIG. 1, peel angle 14 is about 45 degrees relative to the front of each wave, although it can be within a range of about 30 to 70 degrees, and preferably, within the range of about 40 to 60 degrees, relative to waves 13. Also, peel angle 14 is preferably the same angle as stagger angle 15, although not necessarily so, wherein both are preferably extended at about 45 degrees relative to the front or crest of waves 13, although in other embodiments, the angle can be greater or smaller—see FIGS. 5, 6, 7 and 8—or varied.

Figure 7:
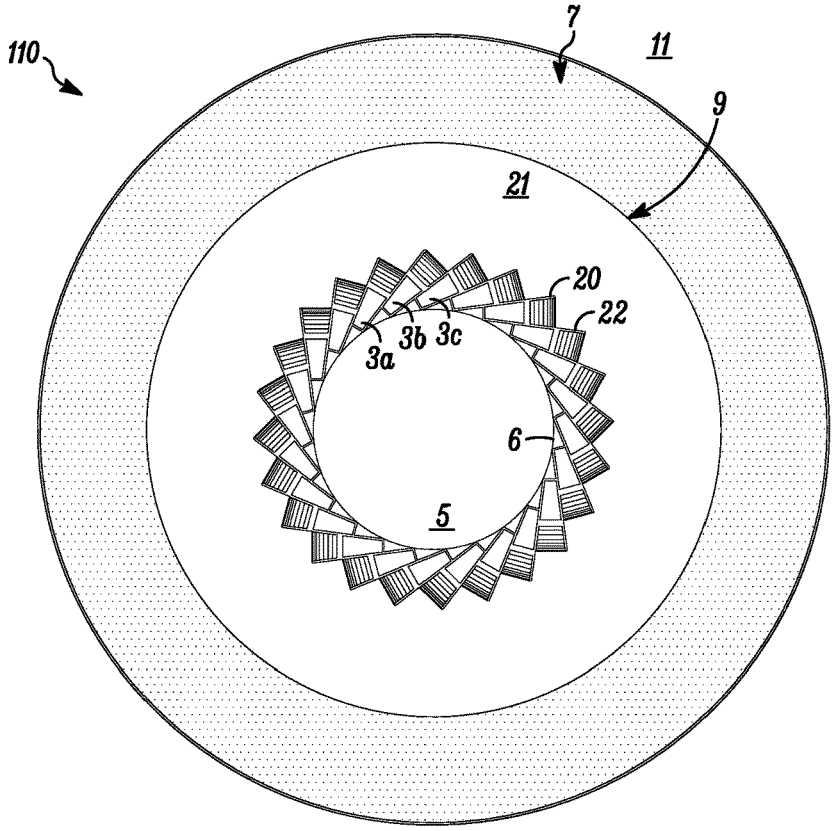
FIG. 7 shows an embodiment with twenty four (24) wave generators having dividing walls with an outward fade angle of about 15 degrees each that extend around a circular stagger line that extends 360 degrees.

Curved stagger line 6 preferably extends along an arcuate path, such as along a segment of a circle along deep end 5, as shown in FIG. 1, wherein its radius can be constant, or varied, depending on the desired configuration of pool 1 and the desired type of wave effects, etc., to be produced. Likewise, breaker line 9 and shoreline 7 preferably extend along a similar or parallel arcuate path, which can match the curvature of stagger line 6, such that the lines extend substantially parallel to each other. For example, breaker line 9 and shoreline 7 can be positioned and curved relative to curved stagger line 6 such that all three curves have concentric radiuses based on a common center point of a circle, as shown in the embodiment of FIG. 7. The relationship between the three lines preferably enables waves 13 to break along break line 9 at substantially the same distance downstream from wave generators 3. At the same time, the curvature and radiuses of the three lines can be modified to accommodate the shaping and peeling of the breaking waves 13 such that they are suitable for surfing, i.e., they don't necessarily have to be extended parallel to each other.

Whether a resultant wave 13 produced by wave pool 1 is suitable for surfing largely depends on the value of peel angle 14 designated as a. And, in this respect, it should be noted that the peel angle should be sufficiently large enough for the lateral velocity of the breaking point of the waves 13 (extending longitudinally along the length thereof) to be suitable for the skill level of the surfer, as well as the height of the resultant wave 13 formed within pool 1. In this respect, it should be noted that the lateral velocity vector, Vs, is preferably equal to the wave celerity vector, c, divided by the sine of the peel angle $\alpha$. When the peel angle is too small, the lateral down-the-line velocity of the breaking waves 13 becomes too fast and therefore the waves can become too difficult to surf on. Whether a particular surfer can handle a particular wave having a particular lateral velocity depends largely on his or her skill level, but also on the height H of wave 13, etc. That is, the higher the wave 13, the smaller the allowable peel angle can be, relative to a fixed skill level, whereas, the greater the lateral down-the-line velocity (resulting from a smaller peel angle), the greater the skill level required.

The table below shows various surfer skill levels (1 being a beginner and 10 being beyond advanced) as a function of the peel angle and wave height H. Note that a peel angle of 90 degrees is of limited use since there is no progressive angle or slope that causes the waves to progressively break and therefore that value is strictly theoretical. Also note that the practical maximum peel angle that produces a meaningful breaking wave for surfing is about 70 degrees. Likewise, the minimum peel angle that produces a breaking wave for surfing is about 30 degrees, insofar as any smaller peel angle will cause the waves to break too quickly and suddenly, thereby not giving the surfer sufficient time to maneuver and ride the wave. Note the descriptions of the ratings contained in the chart below are independent of actual surf break quality or the degree of difficulty of the waves. The chart is taken from Hutt et al. 2001.

| Rating | Description of Rating | Peel Angle Limit (deg) | Min/Max Wave Height (m) |
|---|---|---|---|
| 1 | Beginner surfers not yet able to ride the face of a wave and simply move forward on a whitewater bore as the wave advances. | 90 | 0.70/1.00 |
| 2 | Learner surfers able to successfully ride laterally along the crest of a progressively breaking wave. | 70 | 0.65/1.50 |
| 3 | Surfers that have developed the skill to generate speed by 'pumping' on the face of the wave. | 60 | 0.60/2.50 |
| 4 | Surfers beginning to initiate and execute standard surfing maneuvers on occasion. | 55 | 0.55/4.00 |
| 5 | Surfers able to execute standard maneuvers consecutively on a single wave. | 50 | 0.50/ >4.00 |
| 6 | Surfers able to execute standard maneuvers consecutively. Executes advanced maneuvers on occasion. | 40 | 0.45/>4.00 |
| 7 | Top amateur surfers able to consecutively execute advanced maneuvers. | 29 | 0.40/>4.00 |
| 8 | Professional surfers able to consecutively execute advanced maneuvers. | 27 | 0.35/>4.00 |
| 9 | Top professional surfers able to consecutively execute advanced maneuvers. | Not reach | 0.30/>4.00 |
| 10 | Surfers in the future | Not reach | 0.3/>4.00 |

Thus, it can be seen that the greater the peel angle, the easier it is for a surfer to ride the waves, and the lower the peel angle, the more difficult it would be. It can also be seen that the higher the peel angle, the greater the distance the waves will have to travel along sloped shoaling floor 21, and therefore, the longer the surfers may be able to ride the waves. On the other hand, if the peel angle is too high, such as greater than 70 degrees, the waves are likely to break too slowly, or not break at all, making it difficult for surfing maneuvers to be performed. At the same time, it can be seen that with a smaller peel angle, the more compressed the sloped shoaling floor 21 will be (distance-wise), and therefore, the faster the waves 13 will break along the lateral down-the-line direction, wherein, if the peel angle is too small, i.e., less than 30 degrees, the waves will break too quickly, thereby reducing the likelihood that a surfer would be able to travel fast enough to maneuver on the waves properly. Preferably, as waves 13 are formed by wave generators 3 and approach shoreline 7 in travel direction 10, and pass over break line 9, they will begin to break forward and peel laterally, wherein the momentum of the waves will cause them to spill forward and break across pool 1, i.e., progressively in a direction from side wall 2 to side wall 4.

While the peel angle 14 preferably determines the angle at which waves 13 will break relative to sloped shoaling floor 21, the stagger angle 15 preferably determines the angle at which wave generators 3 are oriented and positioned relative to the front or crest of waves 13, or the direction that is normal to travel direction 10 at any given point along curved stagger line 6. And because each wave generator 3 is preferably extended forward downstream relative to each other, by virtue of the stagger distance, at an oblique angle relative to the front or crest of waves 13, each wave generator, i.e., 3*a*, 3*b*, 3*c*, etc., is preferably operated sequentially, one after the other, to form individual wave segments 8*a*, 8*b*, 8*c*, one after the other, that can merge together to form resultant wave 13 that progressively travels in direction 10, which, due to curved stagger line 6, essentially extends along a substantially arcuate path over time, as shown in FIG. 1. Note that because the wave generators are positioned along a curved stagger line 6, the travel direction 10 of each wave segment created by each wave generator is dependent on the angle at which that wave generator is oriented and positioned relative to each other, wherein, each wave segment will begin travelling in a direction that is substantially perpendicular to the front wall 26 of the wave generator 3 that creates it, but as the resultant wave 13 is formed and generated, it will eventually travel along an arcuate path due to the fact that the wave generators 3 are extended along a curved stagger line 6 and are extended at a slight angle relative to each other in a progressive manner from one side to the other.

Each wave generator 3 is preferably operated in sequence with a predetermined time elapsing between them, wherein the interval that exists between each one is preferably equivalent to the time it takes one wave segment to travel from front wall 26 of one caisson 17 to the front wall 26 of the succeeding caisson 17. For example as shown in FIG. 4, if it takes 1 second for a wave segment to travel that distance 69, i.e., the "stagger distance," then, the preferred interval between the activation of adjacent wave generators 3 should also be 1 second. This helps to ensure that each wave segment formed by each wave generator in succession will merge at the appropriate time, and in the appropriate manner, to form a substantially smooth resultant wave 13 that travels forward and across wave pool 1 in direction 10, which, again, extends along an arcuate path over time. The timing can be carried out by a computer that fires each succeeding caisson in sequence at the appropriate time.

As for the timing and frequency of the resultant waves 13, they can be determined by the amount of time that should elapse between each successive cycle of activations. That is, after the wave generators 3 are activated in sequence from one end to the other, then, the cycle can be repeated by activating the same series of wave generators, i.e., from the first wave generator to the last wave generator in the series, for the duration of a given wave frequency. For example, multiple wave generators can be activated one by one in sequence during a time interval of 10 seconds, which forms one cycle, and that cycle can be repeated after allowing sufficient time to charge the wave generators 3, as will be discussed, to complete the cycle before the next cycle begins. The range of cycles can be anywhere from about 10 to 90 seconds or more. This also gives sufficient time for surfers to get into position between waves.

Figure 2:
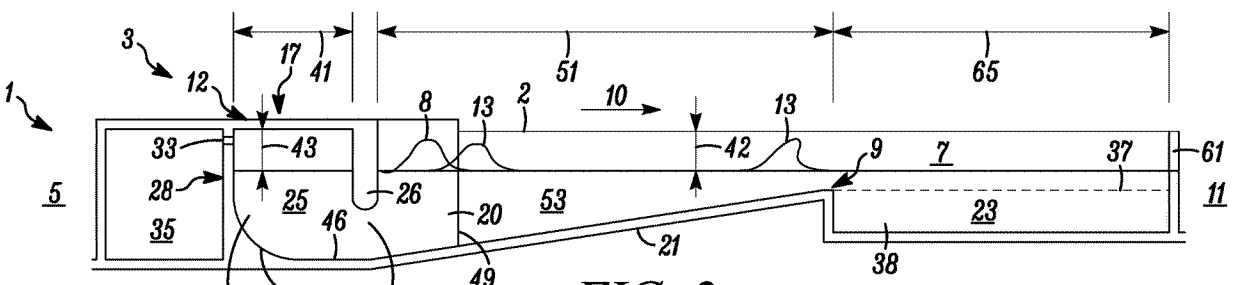

FIG. 2 shows the general cross sectional configuration of pool 1 along a line parallel to the travel direction 10 of waves 13 wherein wave generators 3 are shown extended substantially along deep end 5, i.e., on the left hand side, and shoreline 7 is extended along shallow end 11, i.e., on the right hand side. Extended between deep end 5 and shallow end 11 is preferably a sloped floor 21 that extends upward along the shoaling section 53 followed downstream by break line 9, and a shoreline 7 that is preferably integrated with a wave dampening system 23, like the one shown in U.S. Pat. No. 6,460,201 or 8,561,221, which are incorporated herein by reference. It should be noted that wave dampening system 23 can be omitted and a sloped shoreline 7 of any shape, size or slope can be provided similar to any sloped beach or configuration. This view generally shows waves 13 emanating from wave generators 3 traveling substantially from deep end 5 to shallow end 11, i.e., from left to right, wherein the slope of floor 21 along the wave break zone is preferably between 2% and 22% (depending on the preferred Iribarren number along the wave break zone). The minimum distance of shoaling section 53 from front wall 26 of caisson 17 to break line 9 and from break line 9 to end wall 61 (dampening area) is normally wave size (height/amplitude) dependent. Wave pool 1 can be constructed using conventional materials such as concrete with reinforcing bars, etc.

Each wave generator 3 is preferably housed within caisson 17 which preferably comprises an inverted (up-side-down) watertight column or compartment 25 capable of being filled with air and/or water. Preferably, each caisson 17 has a top wall 12, side walls 18, 19, back wall 28, bottom wall 46, and front wall 26, wherein below front wall 26 is preferably a caisson opening 29 of a predetermined height which allows water and wave energy to pass forward into pool 1. While other types of wave generators, such as those mechanically or hydraulically operated, including those shown in FIGS. 3*a*, 3*b* and 3*c*, can be used and are contemplated by the present invention, the preferred wave generator is pneumatically operated as shown.

Preferably, each caisson 17 has a compressed air chamber 35 immediately behind it, as shown in FIG. 2, in which compressed air can be stored, wherein the compressed air can be released into compartment 25 at the appropriate time through valve opening 33. The air fed into and out of compartment 25 can be stored within chamber 35, wherein during the charging phase, air can be drawn out of compartment 25 and into chamber 35, using a pump (not shown), which can cause the water level within caisson 17 to rise (as back pressure within compartment 25 causes water to be drawn from pool 1 and into compartment 25 through caisson opening 29). In such case, the air drawn out of compartment 25 is preferably compressed into chamber 35, where the compressed air can then be stored until it is ready to be released during the discharge phase. Then, at the appropriate time, i.e., when wave generator 3 is ready to be activated, the compressed air within chamber 35 is released and/or pumped back into compartment 25, through valve opening 33, which causes water column 45 inside compartment 25 to suddenly drop down, which then forces water within compartment 25 forward through opening 29, thereby forming wave motions in front of wave generator 3 which progress to form wave segment 8 which merges with other wave segments in the series to form a resultant wave 13 that travels forward through pool 1.

During the charging phase, the cavity inside compartment 25 is substantially airtight, such that when air within compartment 25 is drawn out, the water level within compartment 25 rises, wherein due to back pressure, water can be sucked in from pool 1 through caisson opening 29, and into compartment 25. At this point, the caisson freeboard 43, as shown in FIG. 2, within compartment 25, can be reduced and substantially eliminated, i.e., virtually all of the air within compartment 25 can be withdrawn. By withdrawing air from the top of compartment 25 through valve opening 33, which is preferably located near the top, the water level within compartment 25 will naturally rise until such time that compartment 25 is substantially filled with water. This also increases the caisson water depth and pressure head within compartment 25, wherein, by raising the water level within compartment 25, an increased pressure head is created which can be released to force water forward through caisson opening 29.

The forward momentum generated by caisson 17 can be created by gravity alone, or by releasing the compressed air from chamber 35 into compartment 25, or with an ancillary pump, etc., which provides additional energy to create larger waves. Back wall 28 of caisson 17 can be provided with a rounded bottom corner 41, as shown in FIG. 2, to facilitate the movement of water forward through opening 29. This helps create wave motions ahead of front wall 26, which help create wave segments 8 that travel forward in between dividing walls 20, 22, which then progress forward to merge with other wave segments formed by adjacent wave generators in the series, which then form a resultant wave 13 that travels forward through pool 1.

Figure 3A:
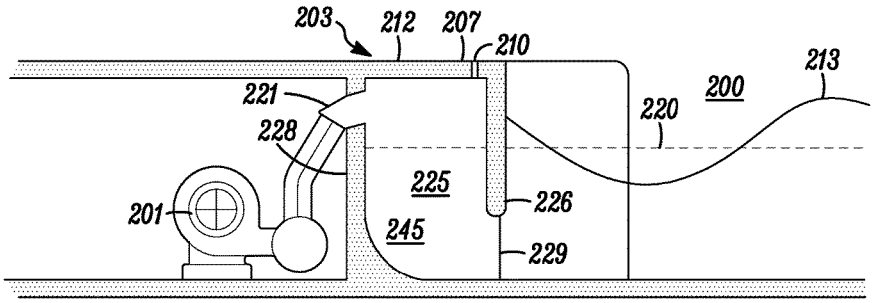
FIG. 3*a* is a section view of an alternate wave generator embodiment consisting of an oscillatory pneumatic wave generator.
Figure 3B:
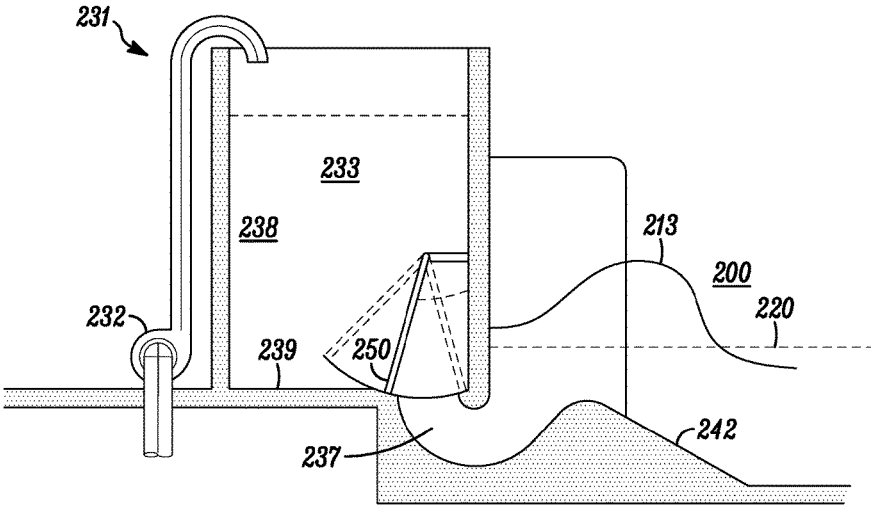
FIG. 3*b* is a section view of an alternate wave generator embodiment consisting of a surge wave generator.
Figure 3C:
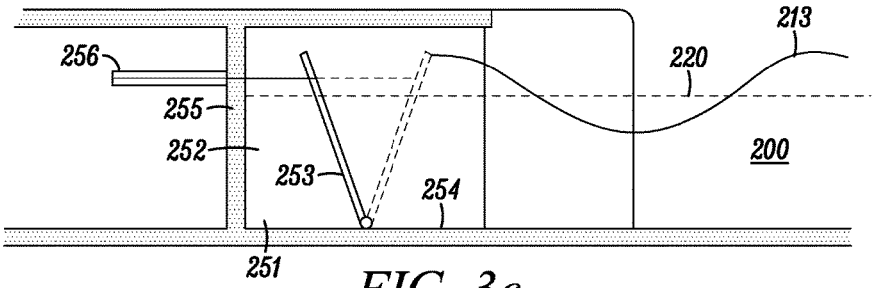
FIG. 3*c* is a section view of an alternate wave generator embodiment consisting of an oscillatory mechanical wave generator.

Virtually any type of wave generator 3 can be used in connection with the present invention including the three types of wave generators shown in FIGS. 3*a*, 3*b* and 3*c*. One is designed to produce non-periodic surge waves and the other two are designed to produce oscillatory waves.

FIG. 3*a* shows an oscillatory pneumatic wave generator 203 which has a concrete caisson 207, with a caisson opening 229 extended below a front wall 226, wherein a blower 201 is provided behind caisson 207 which can inject air into compartment 225. By forcing air into compartment 225, the water level within compartment 225 can be forced to drop, wherein the water column 245 within compartment 225 can be forced forward through the point of least resistance, which is caisson opening 229. This causes water to be forced forward into pool 200, which helps to create wave formation 213.

A valve 221 is preferably provided near the top of compartment 225, within back wall 228, through which air can pass from blower 201 into compartment 225. Accordingly, to discharge air, valve 221 is preferably opened, and blower 201 is activated to pressurize air forward through valve 221. When the air has been discharged into compartment 225, and the water column therein pushed forward through opening 229, wave generator 203 can then be recharged again by allowing air within compartment 225 to be discharged into the atmosphere, through a second opening 210, at or near top wall 212 of caisson 207, wherein by doing so, the water level within compartment 225 will naturally rise again, due to the restoring force of gravity, wherein the water level will eventually reach an equilibrium point relative to the water level 220 in pool 200. By doing so, a column of water 245 is then created within compartment 225 which, during the discharge phase, can be forced downward and forward again, through opening 229, to create additional wave motions in pool 1.

FIG. 3*b* shows a surge wave generator 231 which has a large elevated water storage tank 233 in which water from pool 200 can be stored and released at the appropriate time. A gate 250 is preferably provided near the bottom 239 of tank 233 which can be used to open and close tank opening 237. With gate 250 closed, pump 232 is used to fill tank 233 with water, wherein water from pool 200 can be used to increase the water level within tank 233, i.e., above the water level 220 in pool 200, to form a water column 238 having a relatively high pressure head. This helps to create a relatively high water column 238 as well as a pressure head within tank 233, which, when released, i.e., by opening gate 250, forces water column 238 within tank 233 down and forward through opening 237, thereby creating a bore or surge wave 213.

The amount of water released through opening 237 and the "power" (resulting from the static water level in tank 233), combined with the shape of step 242 that extends in front of wave generator 231, can help define the initial wave height and wave shape. Due to the time it takes for water to refill tank 233 and the relatively large gate 250, these wave shapes are often hard to control and the waves are essentially non-periodic. A disadvantage of this type of wave generator for commercial wave/surf pool applications is that the mechanical parts are mostly situated in water and over time they can corrode and rust, such that mechanical parts may need to be repaired or serviced.

FIG. 3*c* shows an oscillatory mechanical wave generator 251 which has a housing area 252 with a pivoting flap 253 hinged on the pool floor 254 which can be used to push water forward to create wave formations 213 in pool 200. Flap 253 is preferably hinged and can swing back and forth by means of a hydraulic actuator 256 or other mechanical device situated on or near back wall 255 and adapted to create periodic movements within wave pool 200. The periodic movement of flap 253 results in periodic (sine shape) waves wherein the initial depth of pool 200 and the amount of swing, together with the swing period, can determine the wave height and wave shape. A disadvantage of this type of wave generator for commercial wave/surf pools is that mechanical parts are situated in water and therefore they tend to need repair or service periodically.

By using wave generators 3 (virtually any type such as those discussed above), wave segment 8, as shown in FIG. 2, is preferably created in front of each caisson 17, and then allowed to merge with other wave segments travelling in substantially the same direction beyond dividing wall 20, and then, as the resultant wave 13 forms and travels forward, the slope of floor 21 helps to cause the resultant waves to begin breaking, such as along break line 9. Preferably, floor 21 is extended along a substantially constant slope, although not necessarily so, and extends upward along an incline from somewhere in front of front wall 26 to the wave dampening area 23, although, in this respect, the slope can be varied depending on the type of wave formation desired, i.e., it can extend substantially horizontally within the wave merging zones and then it can rise to an incline if desired, for example. In any event, the depth of floor 46 within the wave merging zones is preferably sufficient to ensure that wave segments 8 do not begin breaking until resultant wave 13 forms and travels forward toward break line 9, wherein the inclined floor preferably reaches the break depth to cause the waves 13 to begin to break.

As shown in FIG. 2, wave dampening area 23 is preferably extended between break line 9 and far wall 61 of pool 1 along shoreline 7, and preferably comprises a perforated false floor 37, which is extended over a relatively deep floor area 38, which helps facilitate the absorption of wave energy and thereby reduces the energy of the waves, as well as the rip currents and reverse flows that can otherwise occur along shoreline 7. Different versions of wave dampening systems can be used, including those described in U.S. Pat. Nos. 6,460,201 and 8,561,221, which are incorporated herein by reference. In the latter, the porosity of floor 37 helps determine the dampening rate thereof, i.e., the ability of floor 37 to absorb energy and reduce the rebounding effects occurring within pool 1. And by dampening waves 13, and reducing the ancillary wave effects, it becomes possible to increase the frequency of wave production, thereby increasing throughput and facility efficiency, etc.

FIG. 2 shows some key dimensions in relation to pool 1. For example, it can be seen that the following are shown: The caisson length 41 is generally the distance that extends from back wall 28 to front wall 26 within each caisson 17. The caisson freeboard 43 is the vertical distance that extends between the top of water column 45 within compartment 25 and the underside of top wall 12. The caisson opening 29 is the opening in front of each caisson 17 which has a vertical distance between the bottom of front wall 26 and bottom floor 46. Shoaling section 53 has a length 51 which is the distance that extends from front wall 26 of caisson 17 to break line 9, which can vary along the width of caisson 17, since wave direction 10 is oblique relative to break line 9, and break line 9 is also curved. Floor 21 which forms shoaling section 53 is shown having a constant slope, which extends upward from caisson 17 to break line 9, wherein in the preferred embodiment, the slope can range from 2 to 22 degrees, although not necessarily so, i.e., the floor 21 can also have a varied slope such as within substantially the same range from one end to the other, or a substantially horizontal floor extended within the wave merging zones before sloping upward.

The height of side walls 2, 4, relative to the standing mean water level in pool 1, is shown as distance 42 in FIG. 2, which is preferably higher than the highest possible wave that can be created within pool 1. Distance 42 preferably ranges from between about 2 feet to 10 feet or more to ensure that any wave formed within pool 1 can be maintained by walls 2, 4. Dividing walls 20, 22 are also preferably about the same height to ensure that wave segments 8 are properly maintained, although not necessarily so. It should be noted that dividing walls 20, 22, and walls 2, 4, to the extent applicable, help to allow the wave segments to develop properly and consistently as they travel forward before merging with other wave segments downstream. This way, when the wave segments merge, the likelihood of forming undesirable motions, including unwanted eddies and flow sheers, within the merging zones that can inhibit the proper formation of a smooth resultant wave can be reduced. Finally, dampening distance 65 is the distance that extends between break line 9 and back wall 61.

In FIG. 4, the front width 77 of caisson 17 is shown to be the distance that extends between dividing walls 20, 22 in front of each wave generator 3, along front wall 26, whereas, back width 67 is shown to be the distance that extends between walls 18, 19 along back wall 28 of each caisson 17. The stagger width 68 (not shown) is substantially equal to width 77, but extends between the center lines of each caisson 17, i.e., from center to center between walls 18, 19. In this respect, it should be noted that the stagger width 68 is preferably about twice the length of a surfboard, i.e., from about 2.5 to 5 meters wide, which is based more on practical fabrication considerations than factors necessary to form a smooth wave.

Figure 5:
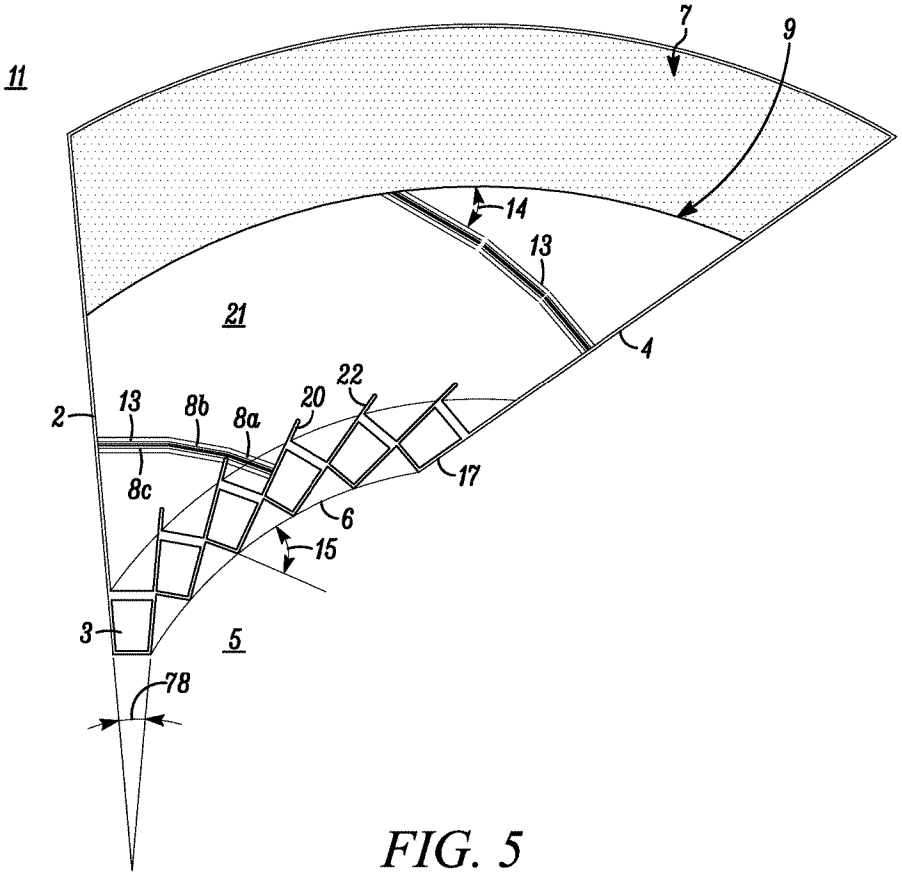
FIG. 5 is a plan view of an embodiment showing how the wave generators are positioned along a curved stagger line and help create wave segments that travel forward and merge together to form a resultant wave, wherein the wave generators are staggered in relation to the travel direction of the wave segments, and the dividing walls have a slight outward fade angle between them, and the wave generators are angled relative to each other.

A pair of dividing walls 20, 22 is preferably extended forward in front of each wave generator 3 in travel direction 10 and at a predetermined outward fade angle 78, as shown in FIG. 5, which is preferably between 0 and 20 degrees. Short dividing wall 20 (shown in FIG. 4 extending forward on the left hand side of each wave generator 3) preferably extends a distance 59 in front of front wall 26 of wave generator 3 to distal end 49, and long dividing wall 22 (shown extending forward on the right hand side of each wave generator 3) preferably extends a distance 70 in front of front wall 26 to distal end 49. As can be seen, for each caisson 17, short dividing wall 20 is preferably extended forward as an extension of wall 18, and long dividing wall 22 is preferably extended forward as an extension of wall 19. Also, both short wall 20 and the downstream portion of long dividing wall 22 of adjacent wave generators are preferably constructed from the same wall, i.e., they are formed by the opposing surfaces of the same wall. Moreover, the upstream portion of long dividing wall 22 is preferably constructed from the same wall 18 of the adjacent caisson 17 in the series. For example, in front of wave generator 3*b* of FIG. 4, long dividing wall 22 (on the right side) is constructed from the same wall 18 as wave generator 3*c* upstream, and from the same wall as short dividing wall 20 of the same wave generator 3*c* downstream. Also, short dividing wall 20 (on the left side) of wave generator 3*b* is constructed from the same long dividing wall 22 of preceding wave generator 3*a*.

Each dividing wall 20, 22 is preferably formed of concrete or other suitable material with a substantially constant thickness such that the opposing surfaces of each dividing wall are substantially parallel to each other. The distal end 49 of each dividing wall is preferably tapered to form a relative thin tip, flange or edge. A separate sheath, such as made of steel or fiberglass, etc., can be extended forward at distal end 49 of dividing walls 20, 22, to form the tip to facilitate smooth merging of the wave segments.

The caisson offset or stagger distance 69, as shown in FIG. 4, is the downstream distance that extends from front wall 26 of one caisson, such as 17*b*, to the front wall 26 of the succeeding caisson, such as 17*c*, in the series, which is in travel direction 10 of each wave segment, which is also the distance that each wave segment must travel before the next adjacent wave generator is activated in sequence. The stagger angle 15, shown in FIG. 1, can vary from one embodiment to the next, but preferably, it is equal to or close to the peel angle 14. The stagger angle 15 can be substantially constant across the width of pool 1, as shown in FIG. 1, but it can also vary over the width of pool 1. In general, the maximum stagger efficiency is achieved when the stagger angle is equal to the peel angle, although, for aesthetic design purposes, or where alteration of shoaling distance 51 is desired (e.g., to save on construction costs, or satisfy local site conditions, or accommodate a breaking wave in accordance with the skill of a surfer), variability in the peel angle 14 and/or stagger angle 15 is permitted.

At the same time, any changes to stagger angle 15 should be constrained by the following: (1) if the stagger angle exceeds the peel angle, then, at some point, the resultant waves may break too quickly, i.e., the minimum shoaling distance 51 to wave break distance may become too small, which can make surfing more difficult; and (2) if the stagger angle is less than the peel angle, then, at some point, the resultant wave may take too long to break, wherein the shoaling distance 51 for waves 13 may be too long, which can increase the overall size and cost of the pool and potentially jeopardize its economic viability.

FIG. 4 shows each caisson 17*a*, 17*b*, 17*c*, 17*d*, etc., in the series having two dividing walls 20, 22 extending forward in front of each wave generator, 3*a*, 3*b*, 3*c*, 3*d*, wherein the distal end 49 of short dividing wall 20 is preferably shorter (in the travel direction 10) than the distal end 49 of long dividing wall 22, which is a function of the stagger distance 69 and stagger angle 15, i.e., the greater the stagger angle 15, the greater the stagger distance 69. Preferably, when stagger angle 15 is about 45 degrees, the stagger width 68 will be substantially equal to the stagger distance 69, but not necessarily so, given that stagger line 6 is curved. For example, when each caisson 17 is 4.0 meters wide, then, the preferred stagger distance 69 is also about 4.0 meters, although this doesn't take into account the curve of stagger line 6 as shown in FIG. 1. Note that the embodiment shown in FIG. 4 has a stagger angle 15 that is slightly greater than 45 degrees, i.e., it is more like 50 or 55 degrees, so stagger distance 69 is greater than stagger width 68, whereas, the embodiment shown in FIG. 1 shows stagger distance 69 is substantially the same as stagger width 68.

Also, the forward extension of dividing walls 20, 22, i.e., distances 59 and 70, can be determined based on the desired distance needed to ensure that wave segments 8*a*, 8*b*, 8*c* are allowed to form properly before merging with other wave segments. In many cases, short dividing wall 20 can be terminated about half the distance that long dividing wall 22 extends forward in front of front wall 26, although not necessarily so, i.e., the embodiment shown in FIG. 4 shows the short dividing wall 20 extending less than half that distance in front of wall 26. The actual distance preferably takes into account the stagger angle 15 and stagger distance 69, as well as the height of the wave segment, and the depth of the deep end 5 of pool 1, as these dimensions will determine how fast the wave segments will travel forward, and therefore, how far forward dividing walls 20, 22 should extend relative to front wall 26 to enable the wave segments to form properly. The given dimensions and angles are for exemplary purposes only; it should be understood that other distances and angles can be used without departing from the intent and purpose of the present invention.

Multiple wave merging zones are preferably created in front of each wave generator 3, between and in front of dividing walls 20, 22. For example, as shown in FIG. 4, a Wave Formation Zone 30 is formed directly in front of each wave generator 3, between dividing walls 20, 22, and ending along dashed line 56, and then, just beyond Zone 30, a Partial Wave Merging Zone 52 is created, extending from dashed line 56 to dashed line 58, and then, just beyond Zone 52, a Full Wave Merging Zone 54 is created, extending from dashed line 58 in direction 10. Each Zone, 30, 52 and 54, is preferably defined along the sides (in direction 10) by either the dividing walls, or the convergence line 60, as will be discussed. These Zones are defined in each instance by the distance the wave segments will travel, and how far dividing walls 20, 22 extend downstream. For example, Wave Formation Zone 30 preferably extends from front wall 26 to distal end 49 of short dividing wall 20, whereas, Partial Wave Merging Zone 52 preferably extends from distal end 49 of short dividing wall 20 to distal end 49 of long dividing wall 22, ending along dashed line 58. Then, Full Wave Merging Zone 54 extends forward from distal end 49 of long dividing wall 22, along dashed line 58, and forward into pool 1 (beyond dashed line 58).

Within first Wave Formation Zone 30, because dividing walls 20, 22 are extended substantially forward on either side, at only a slight outward fade angle between them, such as less than 20 degrees, as the wave segments 8*a* travel forward, the length and energy of the wave segments is substantially confined on both sides (as well as along the bottom and back), to prevent the wave segments from significantly elongating or spreading out in the lateral down-the-line direction. By confining the wave segments in this manner, the energy of the wave segments is conserved, such that their height/amplitude and shape are substantially maintained, i.e., they stay about the same size and shape as they travel forward, although they will drop down in height gradually as they elongate over time. Thus, it can be seen that Zone 30 helps to preserve the energy of the wave segments 8*a* so that they can develop properly and fully between dividing walls 20, 22 and will not unduly elongate or lose significant energy or significantly shrink in height/amplitude or change in shape before merging with other wave segments downstream.

Ideally, dividing walls 20, 22 are extended substantially parallel to each other, but due to the curve of curved stagger line 6, they are necessarily "off parallel" to some degree, i.e., by up to about 20 degrees, which represents the preferred maximum outward fade angle 78 between them, as shown in FIG. 5. This outward fade angle 78 of dividing walls 20, 22 also enables wave generators 3 to be oriented and positioned at an angle relative to each other, i.e., at the same angle 78 shown in FIG. 5, such that they are progressively angled from one end of the pool to the other, i.e., across the width of pool 1. This enables wave segments 8 that travel forward in direction 10 to travel in a direction that is substantially parallel to each other along the convergence line 60, as shown in FIG. 4.

By limiting the outward fade angle between the dividing walls, the following advantages can be achieved: 1) a free surface transition zone is created in front of each wave generator 3, wherein, as the wave segments travel forward through Wave Formation Zone 30, the waves will have adequate time and distance to properly form into a smooth wave shape, wherein by confining the wave segments as they move forward, the kinetic energy/mass transport created by wave generator 3 can be channeled into a smoothly shaped gravity induced wave; 2) as the wave segments travel forward, they will be prevented from unduly elongating or spreading out along the lateral down-the-line direction, which can help maintain the energy and length of the wave segments; and 3) because the wave segments are confined, and their energy is substantially preserved, their height/amplitude and shape will be substantially maintained, which can help to keep the wave segments in a substantially constant state—size-wise, height-wise, amplitude-wise and shape-wise—before they merge. Of course, the degree to which they will be substantially maintained will depend on the outward fade angle—the closer to parallel, the better they will be maintained.

Because Zone 30 represents a fully confined area characterized by two dividing walls 20, 22 on either side extended in front of each wave generator 3, with an outward fade angle of less than 20 degrees, it can be seen that the energy of the wave segment traveling through space 30 will be substantially maintained, and therefore, the size (height/amplitude) and shape of the wave segment will remain substantially unaltered prior to entering into Merging Zones 52 and 54. Accordingly, this Zone 30 preferably enables the wave segments to form properly before merging with other wave segments, and helps prevent the wave segments from substantially elongating, shrinking, collapsing or losing energy, etc., such that when the wave segments merge, the size (height/amplitude) of the wave segments will remain substantially constant from one wave segment to the next, as one wave segment merges with other wave segments along convergence line 60, and do so without excess turbulence or disturbance, such as unwanted eddies and flow sheers.

The next zone downstream is the Partial Wave Merging Zone 52 which is characterized by long dividing wall 22 on one side (right side) and open water on the opposite side (left side), wherein this Zone 52 preferably extends from the distal end of short dividing wall 20 (along dashed line 56) and ends at distal end of long dividing wall 22 (along dashed line 58). Even though this Zone 52 does not have two dividing walls on either side to confine the wave segments as Zone 30 does, the wave segments that travel through this Zone 52 are nevertheless confined on the opposite (non-walled) side by the presence of an adjacent wave segment traveling in substantially the same direction, at substantially the same speed, with substantially the same size and shape, i.e., along convergence line 60, which is produced by a preceding wave generator 3 in the series. That is, the "open" side of Zone 52 (on the left side) along convergence line 60 will be confined by an adjacent wave segment formed by a preceding wave generator 3 in the series, and therefore, this wave segment will be substantially confined on both sides, i.e., by dividing wall 22 on one side and the adjacent wave segment on the other side. Accordingly, the merging of these wave segments, 8*b* and 8*c*, necessarily helps to maintain the height/amplitude and shape of the resultant wave 13, wherein together, they merge together to form resultant wave 13. Note that in FIG. 4 multiple wave segments are shown travelling in direction 10 for demonstration purposes only—in an actual application, the periodic cycle will normally be much longer, such that there would be a longer period and distance between successive waves 13.

The next zone downstream is the Full Wave Merging Zone 54 which is characterized by open water on both sides, wherein Zone 54 extends beyond the distal end of long dividing wall 22, in direction 10, and beyond dashed line 58, and into pool 1. After wave segments 8*b* and 8*c* have initially merged within Zone 52 (along convergence line 60 on the left side), it can be seen that the resultant wave will continue to travel forward, and once long dividing wall 22 ends on the opposite end (shown on the right side), wave segment 8*b* will enter Zone 54 (to become wave segment 8*c*), and then, it will merge with another wave segment 8*b* travelling in substantially the same direction on the opposite end (shown along convergence line 60 on the right side), which is created by a succeeding wave generator 3 in the series, wherein the merging of these wave segments, now 8*c* and 8*b*, will occur along convergence line 60, within Zone 54, on the opposite side. Because there is no dividing wall on either side, the wave segments that travel through Zone 54 will be retained on the opposite end by the next succeeding wave segment 8*b* in the series travelling forward, in substantially the same direction, at substantially the same speed, with substantially the same height/amplitude and shape, which is produced by succeeding wave generator 3.

For example, wave segment 8*a* created by wave generator 3*b* within Zone 30 will become wave segment 8*b* within Zone 52, and then, it will merge on the left hand side within Zone 52 with wave segment 8*c* created by wave generator 3*a*. Then, wave segment 8*b* will become wave segment 8*c* within Zone 54, and then, that segment will merge on the right hand side within Zone 54 with wave segment 8*b* created by wave generator 3*c*. And, by ensuring that each succeeding wave segment travels in substantially the same direction, at substantially the same speed, and with substantially the same size and shape, they will continue to form a uniformly shaped resultant wave 13.

As these wave segments merge together in this manner, i.e., along convergence line 60, first on one side, and then, on the opposite side, the size (height/amplitude) and shape of each wave segment preferably remains substantially unaltered, or only altered slightly, such that collectively, they can form a uniformly sized and shaped resultant wave 13. And because the size and shape of the adjacent wave segments are preferably substantially preserved, the merging of these wave segments preferably remains substantially smooth and disturbance-free, wherein undesirable cross-directional and secondary wave formations, and unwanted eddies and flow sheers, that can negatively impact the generation and transition of the resultant waves can be reduced or even eliminated.

As discussed, dividing walls 20, 22 preferably have an outward fade angle 78 of less than 20 degrees relative to each other, and because the fade angle 78 also determines the angle at which the wave generators 3 are oriented and positioned relative to one another, from a practical standpoint, extending the fade angle beyond 20 degrees can be problematic from the standpoint of the pool's overall configuration. For example, the embodiment shown in FIG. 5 has dividing walls 20, 22 that have an outward fade angle of about 15 degrees, wherein only six wave generators 3 can be fitted within a quarter of a circle, i.e., 90 degrees, and wherein only twenty-four wave generators 3 can be fitted within a full circle as shown in FIG. 7. Increasing the outward fade angle therefore can effectively reduce and tighten the radius of curved stagger line 6, thereby causing the resultant waves 13 to have a tighter arc, which can make it more difficult to form smooth resultant waves for surfing. On the other hand, reducing and tightening the radius of curved stagger line 6 has the advantage of being able to make pool 1 smaller, which can reduce overall costs, including the number of wave generators 3 that have to be installed and used.

In any case, when there is a fade angle 78 that exists between dividing walls 20, 22, the angle of the dividing walls can influence how the wave segments will develop and transition as they travel downstream, wherein several factors are preferably taken into account to ensure that a uniformly shaped, smooth resultant wave 13 can be formed within pool 1, as follows:

First, because any degree of fade will cause the wave segments 8 to elongate or spread out, which in turn, can create a lateral down-the-line velocity vector (extending longitudinally along the down-line arc length of wave segment 8), when the wave segments actually merge, they can, to the extent they elongate, collide against each other, wherein it will be desirable to limit the fade angle to the extent necessary to reduce or even eliminate this tendency. By limiting the fade angle, the spread velocity of each wave segment can be reduced, wherein, the additional wave effects that can otherwise create undesirable disturbances and turbulence such as cross-directional and secondary wave formations, unwanted eddies and flow sheers, can be limited.

Second, another factor is the relationship that exists between the height of a wave segment and its speed, wherein, when the waves are taller, the forward speed of the waves will also be increased. Therefore, when the wave speed is increased, the spread velocity of the wave segments as they elongate along the outward fade angle will also increase, thereby potentially causing the wave segments to form dissonate surface effects as they merge. On the other hand, these two factors may not be as critical in connection with the curved embodiment of the present invention insofar as when the wave generators are oriented and positioned along a curved stagger line 6, the adjacent wave generators in the series will also be positioned at an angle relative to each other, such that each wave segment they create will travel in a direction that is substantially perpendicular to the front wall 26 of each wave generator, wherein, as they merge together, they will travel in a direction 10 in front of each wave generator, which, along convergence line 60, will be substantially parallel to each other as they merge. That is, by the time the adjacent wave segments merge together, they will effectively be travelling substantially parallel to one another, along convergence line 60, wherein the chances of creating excessive down-the-line velocities and forces that impact the formation of the resultant waves will be reduced.

What this means in connection with the second factor discussed above is that the likelihood of there being a significant collision that will negatively impact the formation of the resultant waves as a function of wave speed will be reduced, insofar as, even with an increased wave speed, if the adjacent wave segments are travelling in substantially the same direction, i.e., parallel to one another, there will be less impact between them. That is, by reducing the tendency of the wave segments to impart a down-the-line velocity against each other, the net speed at which they merge together will not significantly affect the formation of the resultant waves, i.e., even if there is an increase in wave speed, wherein that fact alone should not translate into a significant increase in the forces applied when the wave segments merge. Therefore, in addition to the first factor discussed above, it should be noted that the second factor will be less significant in connection with the curved stagger line disclosed herein.

Third, because of the principle of energy conservation, whenever a wave segment is allowed to elongate, it necessarily means that the height/amplitude of the wave will also decrease, and therefore, another factor to consider is the extent to which the wave segments will decrease in height/amplitude as a result of the higher fade angle, which will, in turn, translate into a shorter/smaller resultant wave 13. That is, the higher the fade angle that exists between dividing walls 20, 22, the more the wave segments will elongate and spread out, and therefore, the smaller/shorter the wave segments will be, which will reduce the overall height/amplitude of resultant wave 13. Accordingly, when the fade angle is too high, to produce the same size resultant wave, the wave segments will have to start out taller, which in turn, will increase the amount of energy needed to create the initial wave segment, which means that larger and/or more powerful wave generators will be needed to produce the same size resultant wave. For these reasons, it is desirable to take into account the maximum outward fade angle to ensure that the height/amplitude of the resultant wave can be preserved.

Fourth, because the wave generators are staggered, as discussed above, it can be seen that when two adjacent wave segments merge, one of the wave segments will have traveled further downstream than the adjacent wave segment in the series. And because the fade angle of the dividing walls will cause each wave segment to elongate and reduce in height as it progresses forward, the relative size, height and amplitude of the merging wave segments will eventually differ. That is, one wave segment will have traveled further downstream than the adjacent wave segment, and therefore, when the two wave segments merge, depending on the fade angle, a wave height differential may be created between them, which can adversely affect how the segments merge. Accordingly, not only will there be a wave width differential as the wave segments elongate, but there will also be a wave height differential as the wave segments merge, which can potentially cause undesirable disturbances and turbulences to occur such as along convergence line 60, and especially along the top breaking portion of each wave. In other words, because of the stagger distance, and the need for each wave generator to be activated sequentially, one after the other, one wave segment will inevitably travel further downstream than the adjacent wave segment in the series, in which case, one wave segment will elongate and spread out further than the other by the time they merge, wherein a wave height/amplitude differential may end up existing, which can cause undesirable disturbances and turbulences, such as cross-directional and secondary wave formation, unwanted eddies and flow sheers, to occur.

Technically speaking, assuming that the caisson width is defined as W0, and the energy flux generated along the convergence line is defined as E0, then, the energy flux per unit width at the caissons is E0/W0. At the point where the wave segments merge, W1 and W2 represent the widths of two merging wave segments, and since the total energy flux E0 per caisson is still equal, the energy flux of the two merging wave segments per unit width are E0/W1 and E0/W2 respectively. And since energy flux per unit length is proportional to wave height squared there will be a wave height differential when the two wave segments merge that is equal to wave height H1 and H2 respectively. This wave height differential can be calculated by H2/H1=SQRT(W1/W2). So, if W2 (the wave segment of the most forward caisson) is, for example, 0.8×W1 (the wave segment of the preceding adjacent caisson), H2/H1=SQRT(1/0.8)=1.118 or in other words, H2 is 11.8% higher at the point of merge than H1.

Also, after resultant wave 13 is formed, there will be a tendency for the height/amplitude of the resultant wave 13 to even out over time/distance, wherein the higher points along the crest of wave 13 will want to drop down to the height of the lower points along the crest, due to the restoring force of gravity acting on the wave, i.e., as water seeks its own level. This can cause a certain amount of undesirable changes in motion to be created, extending laterally along the length of the forward moving crest of resultant wave 13, which is another reason why it is desirable to limit the outward fade angle to less than 20 degrees. At the same time, because resultant wave 13 will continue to arc and elongate and spread out over time/distance, i.e., as the resultant wave travels forward after the wave segments merge, the likelihood of these motions negatively affecting the shape of the wave will be reduced.

In this embodiment, because the ends of the wave segments will travel in substantially the same direction, i.e., substantially parallel to each other, along convergence line 60, even if one wave segment starts out taller than an adjacent wave segment, and therefore, travels faster, the net effect is that because there is little or no concomitant increase in the convergence or collision forces that may be exerted between adjacent wave segments, the merging of the wave segments will not necessarily create undue greater turbulence, eddies, etc., other than those created by the wave height/amplitude differential discussed above, which is a function of the outward fade angle 78 and stagger distance 69.

In any event, while there may be no absolute cut off point for the allowable amount of outward fade angle that can exist between any two dividing walls, it is clear that when the fade angle is too high, and/or when the waves are traveling too fast or start out too high, and/or when the stagger angle and/or distance is too great, etc., the combination of forces may make it less likely that a high quality resultant wave suitable for surfing can be produced. Accordingly, the present invention contemplates that the above factors should be taken into account when designing a wave pool of this kind, wherein the amount of excess turbulence and disturbance that can be tolerated as the wave segments merge together will be a function of the above factors, including the outward fade angle that exists between the dividing walls.

Figure 6:
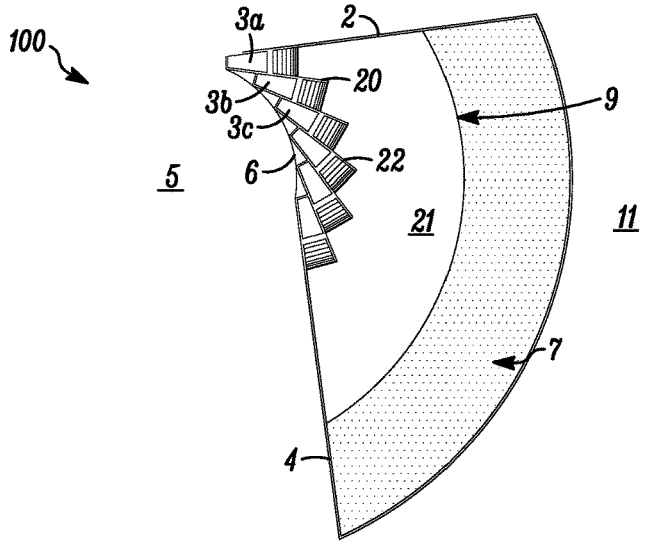
FIG. 6 shows an embodiment with six (6) wave generators having dividing walls with an outward fade angle of about 15 degrees each that extend along a curved stagger line that extends about 90 degrees outward.
Figure 8:
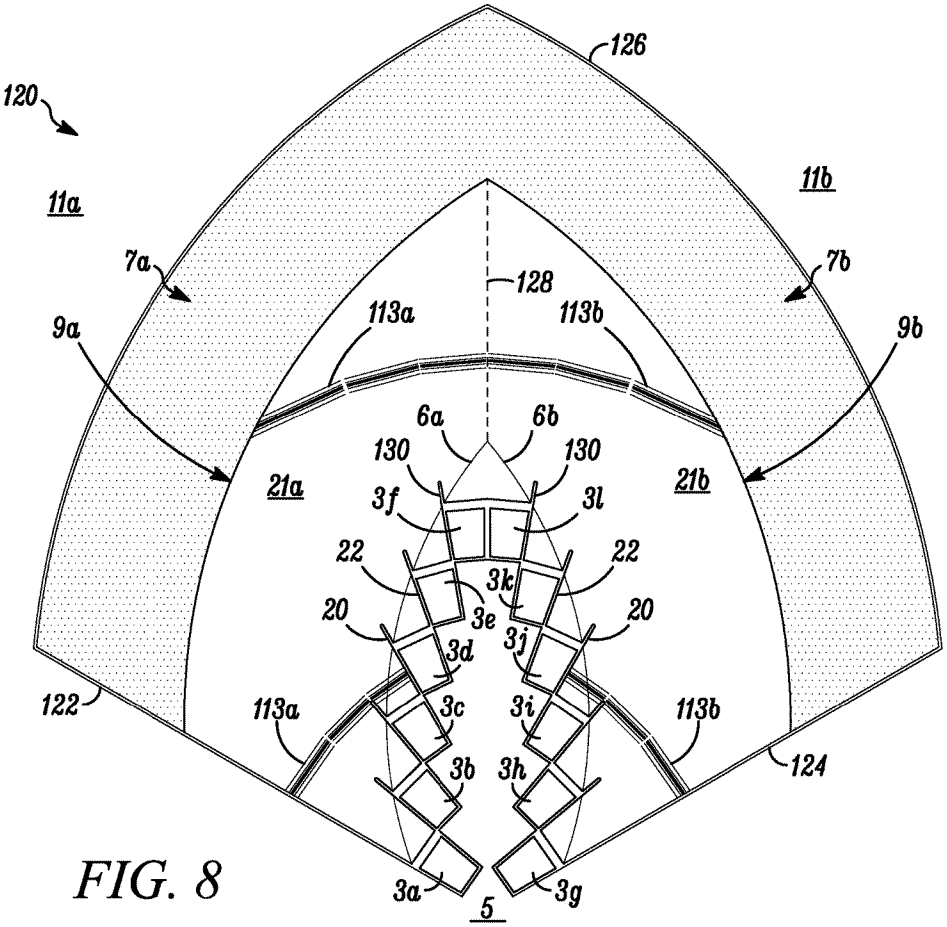
FIG. 8 shows an embodiment with twelve (12) wave generators having dividing walls with an outward fade angle of about 15 degrees each, wherein half are extended around one side on a curved stagger line that extends about 90 degrees, and the other half are extended along the other side on a curved stagger line that extends about 90 degrees, wherein the configuration forms a symmetrical arrowhead shape.

FIGS. 6-8 show examples of wave pools with different configurations each having a similar curved arrangement of wave generators 3 with dividing walls 20, 22 extended forward therefrom, wherein each wave generator is extended along a curved stagger line 6. In each case, the wave generators 3 are substantially similar but the overall configuration, including the total number of wave generators in each embodiment, and the how they are oriented differ from one to the other.

FIG. 6 shows embodiment 100 having six wave generators 3 with dividing walls 20, 22 extended in front of each generator, wherein each pair of dividing walls has an outward fade angle of about 15 degrees and the wave generators are oriented at about 15 degrees relative to each other, i.e., wave generator 3*a* is angled 15 degrees relative to wave generator 3*b*, and wave generator 3*b* is angled 15 degrees relative to wave generator 3*c*, etc., wherein a total of six wave generators 3 are extended around the curvature from about zero degrees to ninety degrees, or a quarter of a circle, when taking into account side walls 2, 4. Wave generators 3 are positioned along deep end 5 along curved stagger line 6 and extended across pool 100 is a similarly curved break line 9 and a curved inclined shoreline 7 extended along shallow end 11.

FIG. 7 shows a similar embodiment 110 having twenty-four wave generators 3 with dividing walls 20, 22 extended in front of each generator, wherein the dividing walls also have an outward fade angle of about 15 degrees. In this embodiment, the wave generators 3 are also oriented at about 15 degrees relative to each other, i.e., wave generator 3*a* is angled 15 degrees relative to wave generator 3*b*, and wave generator 3*b* is angled 15 degrees relative to wave generator 3*c*, etc., wherein a total of twenty-four wave generators 3 are extended around the full circle, each at about 15 degrees relative to each other. By extending wave generators 3 around a full circle, waves can be created that flow across pool 110, i.e., substantially endlessly, by activating each wave generator 3, one after the other, wherein a continuous resultant wave 13 can be created that flows around and peels along the circular shoreline 7. Wave generators 3 in this embodiment are preferably extended in a circular arrangement around the center of a circle which forms deep end 5, wherein they extend along a similar curved (circular) stagger line 6. A similarly curved break line 9 and inclined shoreline 7 are also extended around the full circle, i.e., around the outer perimeter, concentrically having a common center point, which forms shallow end 11.

FIG. 8 shows another embodiment 120 having twelve wave generators 3 with dividing walls 20, 22 extended in front of each generator, wherein the dividing walls also have an outward fade angle of about 15 degrees. This embodiment also has wave generators 3 that are oriented at about 15 degrees relative to each other, i.e., wave generator 3*a* is angled 15 degrees relative to wave generator 3*b*, and wave generator 3*b* is angled 15 degrees relative to wave generator 3*c*, etc., wherein a total of six wave generators 3*a*, 3*b*, 3*c*, 3*d*, 3*e*, 3*f*, are extended along curved stagger line 6*a* on one side, from about zero degrees to about ninety degrees, or a quarter of a circle.

But unlike embodiment 100, embodiment 120 includes a similar but opposing arrangement of six wave generators 3*g*, 3*h*, 3*i*, 3*j*, 3*k*, 3*l*, extended along a similar but opposite facing curved stagger line 6*b*, which is extended in an inverted manner on the opposite side. Thus, embodiment 120 has wave generator 3*g* angled 15 degrees relative to wave generator 3*h*, and wave generator 3*h* angled 15 degrees relative to wave generator 3*i*, etc., wherein a total of six wave generators, 3*g*, 3*h*, 3*i*, 3*j*, 3*k*, 3*l*, are extended along a similar curved stagger line 6*b* on the opposing side, forming another ninety degrees, or a quarter of a circle, of wave generators 3 facing the opposite direction. The overall configuration is, in plan view, similar to the shape of an arrowhead, with side walls 122 and 124 on either side, and a similarly curved break line 9*a* and inclined shoreline 7*a* extended along a shallow end 11*a*, and an opposing but similarly curved break line 9*b* and inclined shoreline 7*b* extended along an opposing shallow end 11*b* on the opposite side.

Each half preferably produces waves 113 in much the same manner as embodiment 100 of FIG. 6 insofar as they each have six wave generators 3 extended along a curved stagger line 6 that extends about a quarter of a circle around. But because each half is configured to adjoin each other at the far end 126, along convergence line 128, it can be seen that as the two resultant waves 113*a* and 113*b* are created by the wave generators 3 on either side, they will eventually merge together along convergence line 128, extending forward along a pair of center dividing walls 130 extended downstream. By configuring the two halves in this manner, resultant waves 113*a* and 113*b* are preferably formed by the respective halves and then travel forward across pool 120 and then eventually merge together along convergence line 128, to form a single resultant wave 113 that travels forward and breaks along the break lines 9*a* and 9*b* that extend toward far end 126. And because the sloped shorelines 21*a* and 21*b* are sloped toward each other, and break lines 9*a* and 9*b* intersect in the center, along convergence line 128, the peeling waves 113*a* and 113*b* that travel forward across opposing shorelines 7*a* and 7*b* will eventually meet and break at far end 126.

Alternatively, waves 113*a* and 113*b* can be made out of phase, wherein, there would either be no convergence and a significant reduction in wave height as the wave spreads out across the end of the pool, or a dissonant wave merger offset from the convergence line 128 depending upon the timing differential of the interacting wave forms.

Figure 9:
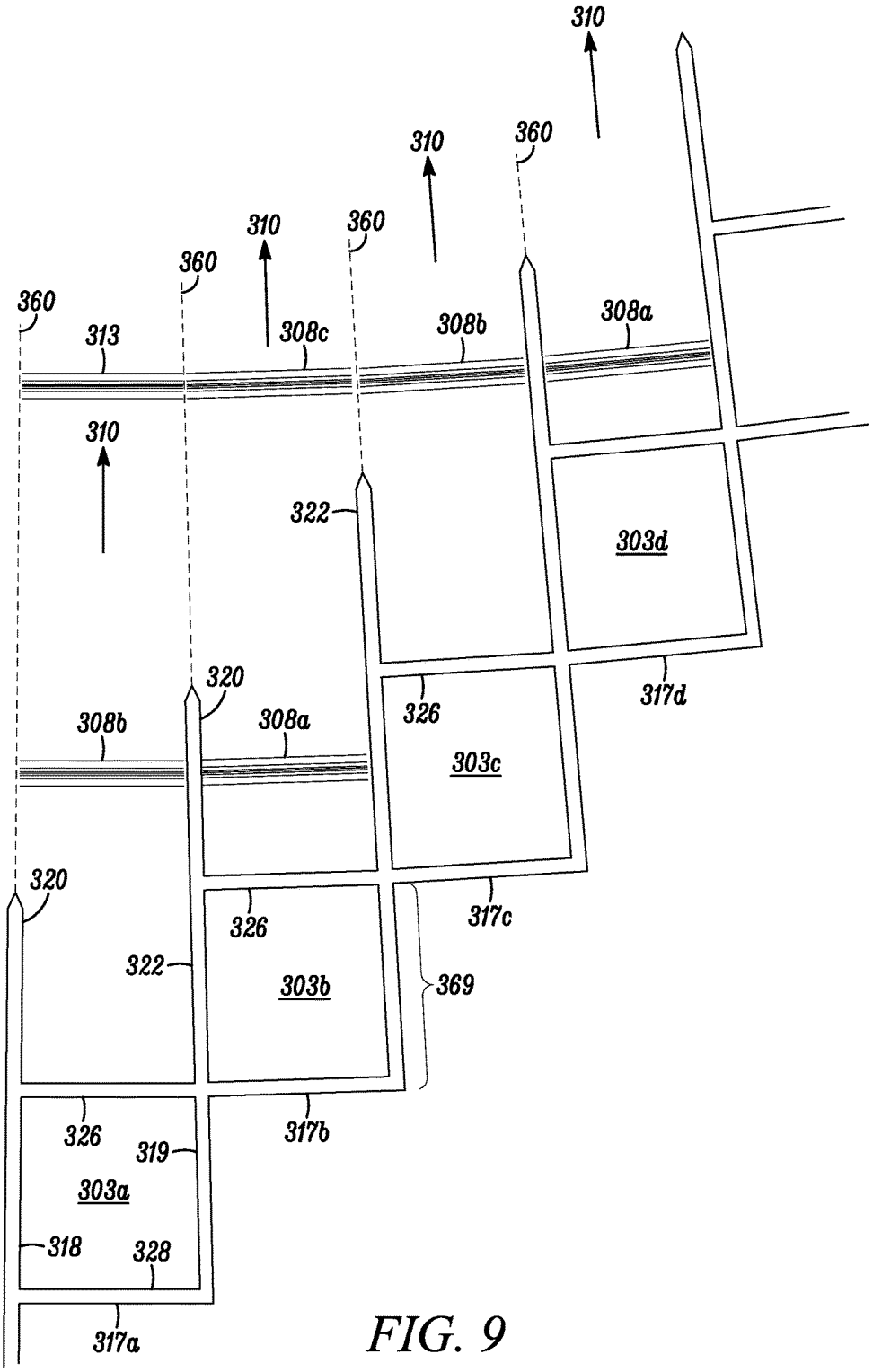
FIG. 9 shows an alternate embodiment with dividing walls having a slight inward fade angle between them, rather than an outward angle, wherein two dividing walls are extended in front of each wave generator, and three wave formation zones are created in front of each wave generator.

FIG. 9 shows an alternate embodiment with dividing walls 320, 322 extended in front of each wave generator, 303*a*, 303*b*, 303*c*, 303*d*, wherein the dividing walls have a slight inward fade angle between them rather than an outward angle. This embodiment has multiple wave generators 303 formed by multiple caissons, 317*a*, 317*b*, 317*c*, 317*d*, each of which is preferably in the shape of a substantial rectangle from above, including front wall 326, a pair of side walls 318, 319, and a back wall 328, wherein a pair of dividing walls 320, 322 is preferably extended substantially longitudinally forward in direction 310 in front of each wave generator 303. In this case, dividing walls 320, 322 are preferably inwardly angled relative to each other, wherein wave generators 303 are also inwardly angled relative to each other, such that they are extended along an inverted curved stagger line, to accommodate the arrangement shown.

In this embodiment, dividing walls 320, 322 are preferably extended substantially close to parallel to each other, but with a slight inward fade angle, wherein the embodiment shown has an inward fade angle of about one or two degrees. And because the fade angle of dividing walls 320, 322 is inward, each succeeding wave generator 303 in the series is preferably angled inward relative to each preceding wave generator 303 in the series. For example, wave generator 303*b* is angled inward about one or two degrees relative to wave generator 303*a*, and wave generator 303*c* is angled inward about one or two degrees relative to wave generator 303*b*, wherein wave generator 303*c* is collectively angled inward about two to four degrees relative to wave generator 303*a*. And by virtue of the stagger distance 369 between adjacent wave generators 303*a*, 303*b*, 303*c*, 303*d*, it can be seen that collectively the wave generators are extended along an inverted curved stagger line opposite the curvature of line 6 shown in FIG. 1.

The energy of wave segments 308*a* formed by each wave generator 303 will thus be substantially confined in front of each wave generator 303, between dividing walls 320, 322, as they travel forward in travel direction 310, and before they merge together with adjacent wave segments 308*b*, 308*c*, along convergence lines 360. By angling the dividing walls inward, wave segments 308*a* are not only confined on both sides, but as they progress, they will reduce in length, i.e., narrow, rather than elongate, in the lateral down-the-line direction, such that, due to the principle of energy conservation, they will increase in height/amplitude as they progress forward, rather than decrease. And by angling the wave generators inward relative to each other, each wave segment 308*a* will travel in direction 310 (which is slightly angled relative to each other), which will enable the ends of those wave segments to travel in substantially the same direction, i.e., substantially parallel to each other, such that, along convergence lines 360, they will merge together without creating undue turbulence, thereby enabling smooth resultant waves 313 to be created. And then, after wave segments 308*a*, 308*b*, 308*c*, merge together to form resultant wave 313, the wave that is created will continue to narrow and therefore grow in height/amplitude as it travels toward shore. And by increasing the height/amplitude of the resultant wave 313, taller waves that travel faster toward the shoreline can then be created.

The shoreline in this embodiment can be similar to shoreline 7 shown in FIG. 1 except the curve is inverted, along with breaker line 9, which is also inverted. Preferably, all of these curves, i.e., stagger line, breaker line and shoreline, are substantially parallel to each other, although not necessarily so.

Another aspect of the invention relates to a wave dampening system such as disclosed in U.S. Pat. No. 6,460,201 or 8,561,221, which are incorporated herein by reference, and as shown in FIG. 2, which can be provided along the shallow end to reduce undesirable wave effects such as rip currents and reverse flows, etc., which can adversely affect the breaking of the waves along the shoreline. A standard shoreline that has a floor that progresses upward at an incline from the deep end to the shallow end, or other sloped beach can be provided instead.

What is claimed is:

1. A wave pool comprising:

a plurality of wave generators adapted to produce wave segments in said wave pool, wherein said plurality of wave generators is positioned along a sequence and extended in a staggered manner along a curved stagger line relative to the forward travel direction of the wave segments;

a pair of dividing walls extended substantially forward in front of each wave generator of said plurality of wave generators, wherein within each of said pair of dividing walls, said dividing walls are extended with a fade angle of no more than 20 degrees relative to each other, such that said dividing walls help to maintain the energy, height and amplitude of the wave segments that travel forward between said dividing walls;

wherein each of said pair of dividing walls comprises a short dividing wall and a long dividing wall, wherein said long dividing wall is extended further downstream than said short dividing wall, wherein said plurality of wave generators is adapted such that a wave segment formed by one wave generator travels forward and merges with adjacent wave segments formed by adjacent wave generators in the sequence, to form a resultant wave; and a sloped floor extended in said wave pool, wherein said sloped floor comprises an incline that enables the resultant wave to break thereon.

2. The wave pool of claim 1, wherein as each wave segment travels forward between an associated pair of dividing walls, said each wave segment first merges with an adjacent wave segment produced by a preceding wave generator in the sequence after said wave segment passes beyond the associated short dividing wall, and then merges with an adjacent wave segment produced by a succeeding wave generator in the sequence after said wave segment passes beyond the associated long dividing wall.

3. The wave pool of claim 1, wherein a portion of the long dividing wall of one wave generator forms the opposite side of the short dividing wall of an adjacent wave generator in the sequence.

4. The wave pool of claim 1, wherein said curved stagger line extends along a circular arc and wherein said sloped floor extends along a curved breaker line that extends along a substantially parallel circular arc, wherein said curved stagger line extends around a full 360 degrees to form a wave pool having a substantially circular shape.

5. The wave pool of claim 1, wherein said curved stagger line extends along a circular arc and wherein said sloped floor extends along a curved breaker line that extends along a substantially parallel circular arc, wherein said plurality of wave generators comprises a predetermined number of wave generators provided around said circular arc, wherein the overall shape of the wave pool comprises a segment of a circle and is dependent on how many wave generators are provided in the sequence.

6. The wave pool of claim 1, wherein said plurality of wave generators are adapted to be operated in sequence, such that a plurality of wave segments is generated at pre-selected time intervals, wherein as the wave segments travel forward, they merge together to form a substantially uniform resultant unbroken wave that travels forward through said wave pool in a substantially arcuate manner.

7. The wave pool of claim 1, wherein in front of each wave generator, the wave segment travels through the following:

a wave formation zone extending between an associated pair of dividing walls which helps maintain the energy, height and amplitude of the wave segment that travels forward between said pair of dividing walls;

a partial wave merging zone which enables the wave segment that travels forward between said pair of dividing walls to merge with an adjacent wave segment generated by a preceding wave generator in the sequence; and a full wave merging zone which enables the wave segment that travels forward between said pair of dividing walls to merge with an adjacent wave segment generated by a succeeding wave generator in the sequence.

8. The system of claim 7, wherein said partial wave merging zone extends substantially forward from a distal end of the short dividing wall to a distal end of the long dividing wall of the associated pair of dividing walls, wherein said full wave merging zone extends substantially forward from a distal end of the long dividing wall of the associated pair of dividing walls toward said sloped floor of said wave pool.

9. The wave pool of claim 1, wherein within each of said pair of dividing walls, said dividing walls are extended with an inward fade angle of up to one to two degrees relative to each other.

10. A wave generating system comprising:

a wave pool having a first end with a plurality of wave generators arranged in sequence and a second end having a shoreline;

wherein each wave generator of said plurality of wave generators is adapted to produce wave segments that travel substantially forward in front of said wave generator, wherein said plurality of wave generators is extended in a staggered manner and positioned along a curved stagger line relative to the forward travel direction of the wave segments;

a pair of dividing walls extended substantially forward in front of each of said wave generators, wherein within each pair of dividing walls, said dividing walls are adapted with a limited fade angle that helps maintain the energy, height and amplitude of the wave segments that travel forward between them; and wherein within each pair of dividing walls, one dividing wall is extended further downstream than the other dividing wall, wherein each of said pair of dividing walls comprises a short dividing wall and a long dividing wall, and wherein said plurality of wave generators is adapted such that a wave segment produced by one wave generator first merges on one side with a first adjacent wave segment produced by a preceding wave generator in the sequence and then on the opposite side with a second adjacent wave segment produced by a succeeding wave generator in the sequence, to form a resultant wave that extends in a substantially arcuate manner across the wave pool.

11. The system of claim 10, wherein as each wave segment travels forward between an associated pair of dividing walls, each wave segment first merges with the first adjacent wave segment after it passes beyond the associated short dividing wall, and then merges with the second adjacent wave segment after it passes beyond the associated long dividing wall.

12. The system of claim 10, wherein a portion of the long dividing wall of one wave generator forms the opposite side of the short dividing wall of an adjacent wave generator in the sequence.

13. The system of claim 10, wherein said fade angle is less than 20 degrees, and wherein a sloped floor is extended along said shoreline of said second end.

14. The system of claim 10, wherein said curved stagger line extends along a circular arc and said plurality of wave generators comprises a predetermined number of wave generators provided around said circular arc, wherein the overall shape of the wave pool comprises a segment of a circle and is dependent on how many wave generators are provided along the sequence.

15. The system of claim 10, wherein said plurality of wave generators are adapted to be operated intermittently, such that a plurality of wave segments is generated at pre-selected time intervals, wherein as the wave segments travel forward, they merge together first on one side and then on the opposite side, to form a substantially uniform resultant unbroken wave.

16. The system of claim 10, wherein in front of each wave generator, the wave segment travels through the following:

a wave formation zone extending between an associated pair of dividing walls which helps maintain the energy, height and amplitude of the wave segment that travels forward between said pair of dividing walls;

a partial wave merging zone which enables the wave segment that travels forward between said pair of dividing walls to merge with an adjacent wave segment generated by a preceding wave generator in the sequence; and a full wave merging zone which enables the wave segment that travels forward between said pair of dividing walls to merge with an adjacent wave segment generated by a succeeding wave generator in the sequence.

17. The system of claim 16, wherein said partial wave merging zone extends substantially forward from a distal end of the short dividing wall to a distal end of the long dividing wall of the associated pair of dividing walls, wherein said full wave merging zone extends substantially forward from a distal end of the long dividing wall of the associated pair of dividing walls toward a sloped floor of said wave pool.

18. The system of claim 10, wherein a sloped floor is extended along the second end of said wave pool, along a curved breaker line that is substantially similar in curvature to said curved stagger line, wherein the resultant waves are allowed to travel across said wave pool and break obliquely relative to a tangent of said curved breaker line.

19. The system of claim 10, wherein within each of said pair of dividing walls, said dividing walls are extended with an inward fade angle of up to one to two degrees relative to each other.

20. A wave pool comprising:

a plurality of wave generators adapted to produce wave segments in said wave pool, wherein said plurality of wave generators is extended in a staggered manner along a curved stagger line relative to the forward travel direction of the wave segments;

a pair of dividing walls extended substantially forward in front of each wave generator of said plurality of wave generators, wherein within each of said pair of dividing walls, said dividing walls are extended with a fade angle of no more than 20 degrees relative to each other;

wherein within each pair of dividing walls, one dividing wall is extended further downstream than the other dividing wall, and wherein said plurality of wave generators is adapted such that a wave segment formed by one wave generator merges with an adjacent wave segment formed by an adjacent wave generator, to form a resultant wave that travels substantially across the wave pool.

* * * * *